US009856886B2

(12) United States Patent
Kares et al.

(10) Patent No.: US 9,856,886 B2
(45) Date of Patent: Jan. 2, 2018

(54) MULTISTAGE RADIAL COMPRESSOR BAFFLE

(71) Applicant: Honeywell International Inc., Morristown, NJ (US)

(72) Inventors: Vaclav Kares, Strakonice (CZ); Vit Houst, Sestajovice (CZ); Ondrej Lednicky, Novy Jicin (CZ); Michal Mokos, Ivancice (CZ); Milan Nejedly, Brno (CZ); Zbynek Oseljsek, Brno (CZ); Daniel Turecek, Ostopovice (CZ)

(73) Assignee: Honeywell International Inc., Morris Plains, NJ (US)

( * ) Notice: Subject to any disclaimer, the term of this patent is extended or adjusted under 35 U.S.C. 154(b) by 423 days.

(21) Appl. No.: 14/592,120

(22) Filed: Jan. 8, 2015

(65) Prior Publication Data

US 2016/0201683 A1 Jul. 14, 2016

(51) Int. Cl.
*F04D 29/08* (2006.01)
*F04D 29/44* (2006.01)
(Continued)

(52) U.S. Cl.
CPC ..... *F04D 29/083* (2013.01); *F04D 17/12* (2013.01); *F04D 17/122* (2013.01);
(Continued)

(58) Field of Classification Search
CPC ..... F04D 29/083; F04D 17/12; F04D 29/44; F04D 17/122; F04D 29/102; F04D 29/284; F04D 29/2266; F01D 11/02; F01D 11/00
See application file for complete search history.

(56) References Cited

U.S. PATENT DOCUMENTS 1,037,243 A * 9/1912 Guy ..... F04D 29/2266 277/419
4,032,262 A 6/1977 Zehnder
(Continued)

FOREIGN PATENT DOCUMENTS

DE 32 30 511 A1 2/1984
DE 20 2005 006 522 U1 7/2006
(Continued)

OTHER PUBLICATIONS

EPO European Search Report, Application No. 16150106.9-1607, Jun. 8, 2016 (8 pages).

*Primary Examiner* — Gregory Anderson
*Assistant Examiner* — Eldon Brockman
(74) *Attorney, Agent, or Firm* — Brian J. Pangrle

(57) ABSTRACT

An assembly can include a first radial compressor wheel that has a rotational axis and that includes a hub surface that includes an annular ridge disposed at a radius measured from the rotational axis; a second radial compressor wheel that includes a hub surface; and an annular baffle disposed at least in part between the hub surfaces where the annular baffle includes an outer surface and an inner edge that defines an opening having a central axis where the outer surface includes a surface portion to one side of the inner edge that faces the hub surface of the first radial compressor wheel, where the surface portion includes an annular channel over a radial width measured from the central axis and where the radial width spans the radius of the annular ridge.

20 Claims, 17 Drawing Sheets

(51) Int. Cl.

| | |
|---|---|
| ***F04D 17/12*** | (2006.01) |
| ***F04D 29/10*** | (2006.01) |
| ***F04D 29/22*** | (2006.01) |
| ***F04D 29/28*** | (2006.01) |

(52) U.S. Cl.
CPC ..... *F04D 29/102* (2013.01); *F04D 29/2266* (2013.01); *F04D 29/284* (2013.01); *F04D 29/44* (2013.01)

(56) References Cited

U.S. PATENT DOCUMENTS

| | | | | |
|---|---|---|---|---|
| 4,155,684 | A | 5/1979 | Curiel et al. | |
| 6,062,028 | A * | 5/2000 | Arnold | F02C 6/12 417/407 |
| 6,792,755 | B2 * | 9/2004 | Arnold | F01D 5/048 415/102 |
| 6,834,501 | B1 * | 12/2004 | Vrbas | F01D 5/045 123/562 |
| 6,920,754 | B2 * | 7/2005 | Arnold | F01D 5/048 415/102 |
| 7,014,418 | B1 * | 3/2006 | Arnold | F01D 1/22 415/100 |
| 7,407,364 | B2 * | 8/2008 | Arnold | F01D 9/026 415/100 |
| 7,568,883 | B2 * | 8/2009 | Arnold | F04D 17/122 415/100 |
| 7,775,763 | B1 * | 8/2010 | Johnson | F04D 29/167 415/111 |
| 8,123,501 | B2 * | 2/2012 | Gomilar | F01D 25/183 417/407 |
| 9,169,846 | B2 * | 10/2015 | Mariotti | F04D 29/057 |
| 2005/0005606 | A1 * | 1/2005 | Vrbas | F01D 5/045 60/612 |
| 2007/0034195 | A1 | 2/2007 | Wijk et al. | |
| 2010/0266430 | A1 | 10/2010 | Shimizu | |
| 2010/0322781 | A1 * | 12/2010 | Heyes | F04D 29/30 416/244 A |
| 2015/0345373 | A1 | 12/2015 | Knight | |
| 2016/0195100 | A1 * | 7/2016 | Alban | F04D 29/0516 415/120 |

FOREIGN PATENT DOCUMENTS

| | | | |
|---|---|---|---|
| DE | 10 2009 024 679 | A1 | 12/2010 |
| DE | 10 2010 027 220 | A1 | 1/2012 |
| GB | 2508921 | A | 6/2014 |
| WO | 2006005355 | A1 | 1/2006 |
| WO | 2011080047 | A1 | 7/2011 |
| WO | 2014096786 | A1 | 6/2014 |

* cited by examiner

Table 1700

| | 1 RPM | | | | 185000 RPM | | | |
|---|---|---|---|---|---|---|---|---|
| | 150 kPa | | 200 kPa | | 150 kPa | | 200 kPa | |
| | Mass flow | Flow decrease | Mass flow | Flow decrease | Mass flow | Flow decrease | Mass flow | Flow decrease |
| Baffle | (kg/s) | (%) | (kg/s) | (%) | (kg/s) | (%) | (kg/s) | (%) |
| 1380 | 0.00336 | 0% | 0.00336 | 0% | 0.00120 | 0% | 0.00181 | 0% |
| 1080 | 0.00207 | 38% | 0.00237 | 30% | 0.00105 | 12% | 0.00163 | 10% |
| 1180 | 0.00210 | 37% | 0.00241 | 28% | 0.00105 | 12% | 0.00163 | 10% |
| 1280 | 0.00236 | 30% | 0.00263 | 22% | 0.00107 | 11% | 0.00171 | 6% |
| 380 | 0.00193 | **42%** | 0.00221 | **34%** | 0.00088 | **27%** | 0.00135 | **26%** |
| 1480 | 0.00190 | 43% | 0.00217 | 36% | 0.00087 | 27% | 0.00133 | 27% |
| 1580 | 0.00191 | 43% | 0.00217 | 35% | 0.00085 | 29% | 0.00132 | 27% |
| 1680 | 0.00195 | **42%** | 0.00220 | **35%** | 0.00100 | **17%** | 0.00146 | **20%** |

Fig. 17

MULTISTAGE RADIAL COMPRESSOR BAFFLE

TECHNICAL FIELD

Subject matter disclosed herein relates generally to multistage radial compressors.

BACKGROUND

Compressors are frequently utilized to increase output of an internal combustion engine. A turbocharger can include a compressor, which may be a multistage radial compressor. As an example, such a compressor may be driven by a turbine wheel operatively coupled to a shaft that can rotatably drive the compressor or, for example, such a compressor may be driven by another mechanism such as, for example, an electric motor. Various examples of techniques, technologies, etc. described herein pertain to multistage radial compressors.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where:

FIG. 17 is a table that includes information as to various example assemblies.

DETAILED DESCRIPTION

Figure 1:
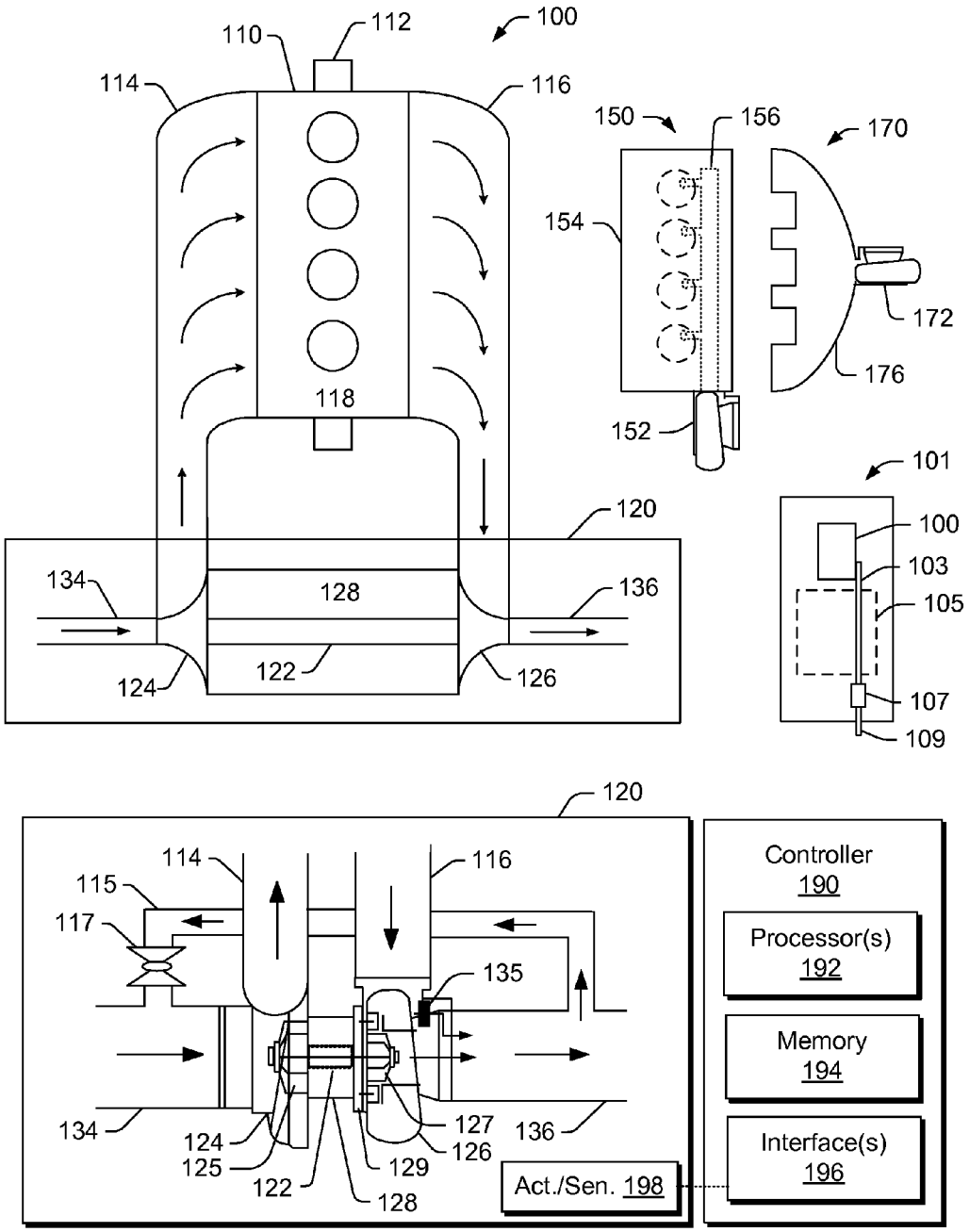
FIG. 1 is a diagram of an example of a turbocharger and an internal combustion engine along with a controller.

Turbochargers are frequently utilized to increase output of an internal combustion engine. Referring to FIG. 1, as an example, a system 100 can include an internal combustion engine 110 and a turbocharger 120. As shown in FIG. 1, the system 100 may be part of a vehicle 101 where the system 100 is disposed in an engine compartment and connected to an exhaust conduit 103 that directs exhaust to an exhaust outlet 109, for example, located behind a passenger compartment 105. In the example of FIG. 1, a treatment unit 107 may be provided to treat exhaust (e.g., to reduce emissions via catalytic conversion of molecules, etc.).

As shown in FIG. 1, the internal combustion engine 110 includes an engine block 118 housing one or more combustion chambers that operatively drive a shaft 112 (e.g., via pistons) as well as an intake port 114 that provides a flow path for air to the engine block 118 and an exhaust port 116 that provides a flow path for exhaust from the engine block 118.

The turbocharger 120 can act to extract energy from the exhaust and to provide energy to intake air, which may be combined with fuel to form combustion gas. As shown in FIG. 1, the turbocharger 120 includes an air inlet 134, a shaft 122, a compressor housing assembly 124 for a compressor wheel 125, a turbine housing assembly 126 for a turbine wheel 127, another housing assembly 128 and an exhaust outlet 136. The housing assembly 128 may be referred to as a center housing assembly as it is disposed between the compressor housing assembly 124 and the turbine housing assembly 126. The shaft 122 may be a shaft assembly that includes a variety of components. The shaft 122 may be rotatably supported by a bearing system (e.g., journal bearing(s), rolling element bearing(s), etc.) disposed in the housing assembly 128 (e.g., in a bore defined by one or more bore walls) such that rotation of the turbine wheel 127 causes rotation of the compressor wheel 125 (e.g., as rotatably coupled by the shaft 122). As an example a center housing rotating assembly (CHRA) can include the compressor wheel 125, the turbine wheel 127, the shaft 122, the housing assembly 128 and various other components (e.g., a compressor side plate disposed at an axial location between the compressor wheel 125 and the housing assembly 128).

In the example of FIG. 1, a variable geometry assembly 129 is shown as being, in part, disposed between the housing assembly 128 and the housing assembly 126. Such a variable geometry assembly may include vanes or other components to vary geometry of passages that lead to a turbine wheel space in the turbine housing assembly 126. As an example, a variable geometry compressor assembly may be provided.

In the example of FIG. 1, a wastegate valve (or simply wastegate) 135 is positioned proximate to an exhaust inlet of the turbine housing assembly 126. The wastegate valve 135 can be controlled to allow at least some exhaust from the exhaust port 116 to bypass the turbine wheel 127. Various wastegates, wastegate components, etc., may be applied to a conventional fixed nozzle turbine, a fixed-vaned nozzle turbine, a variable nozzle turbine, a twin scroll turbocharger, etc. As an example, a wastegate may be an internal wastegate (e.g., at least partially internal to a turbine housing). As an example, a wastegate may be an external wastegate (e.g., operatively coupled to a conduit in fluid communication with a turbine housing).

In the example of FIG. 1, an exhaust gas recirculation (EGR) conduit 115 is also shown, which may be provided, optionally with one or more valves 117, for example, to allow exhaust to flow to a position upstream the compressor wheel 125.

FIG. 1 also shows an example arrangement 150 for flow of exhaust to an exhaust turbine housing assembly 152 and another example arrangement 170 for flow of exhaust to an exhaust turbine housing assembly 172. In the arrangement 150, a cylinder head 154 includes passages 156 within to direct exhaust from cylinders to the turbine housing assembly 152 while in the arrangement 170, a manifold 176 provides for mounting of the turbine housing assembly 172, for example, without any separate, intermediate length of exhaust piping. In the example arrangements 150 and 170, the turbine housing assemblies 152 and 172 may be configured for use with a wastegate, variable geometry assembly, etc.

In FIG. 1, an example of a controller 190 is shown as including one or more processors 192, memory 194 and one or more interfaces 196. Such a controller may include circuitry such as circuitry of an engine control unit (ECU). As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control lubricant flow, temperature, a variable geometry assembly (e.g., variable geometry compressor or turbine), a wastegate (e.g., via an actuator), an electric motor, or one or more other components associated with an engine, a turbocharger (or turbochargers), etc. As an example, the turbocharger 120 may include one or more actuators and/or one or more sensors 198 that may be, for example, coupled to an interface or interfaces 196 of the controller 190. As an example, the wastegate 135 may be controlled by a controller that includes an actuator responsive to an electrical signal, a pressure signal, etc. As an example, an actuator for a wastegate may be a mechanical actuator, for example, that may operate without a need for electrical power (e.g., consider a mechanical actuator configured to respond to a pressure signal supplied via a conduit).

Figure 2:
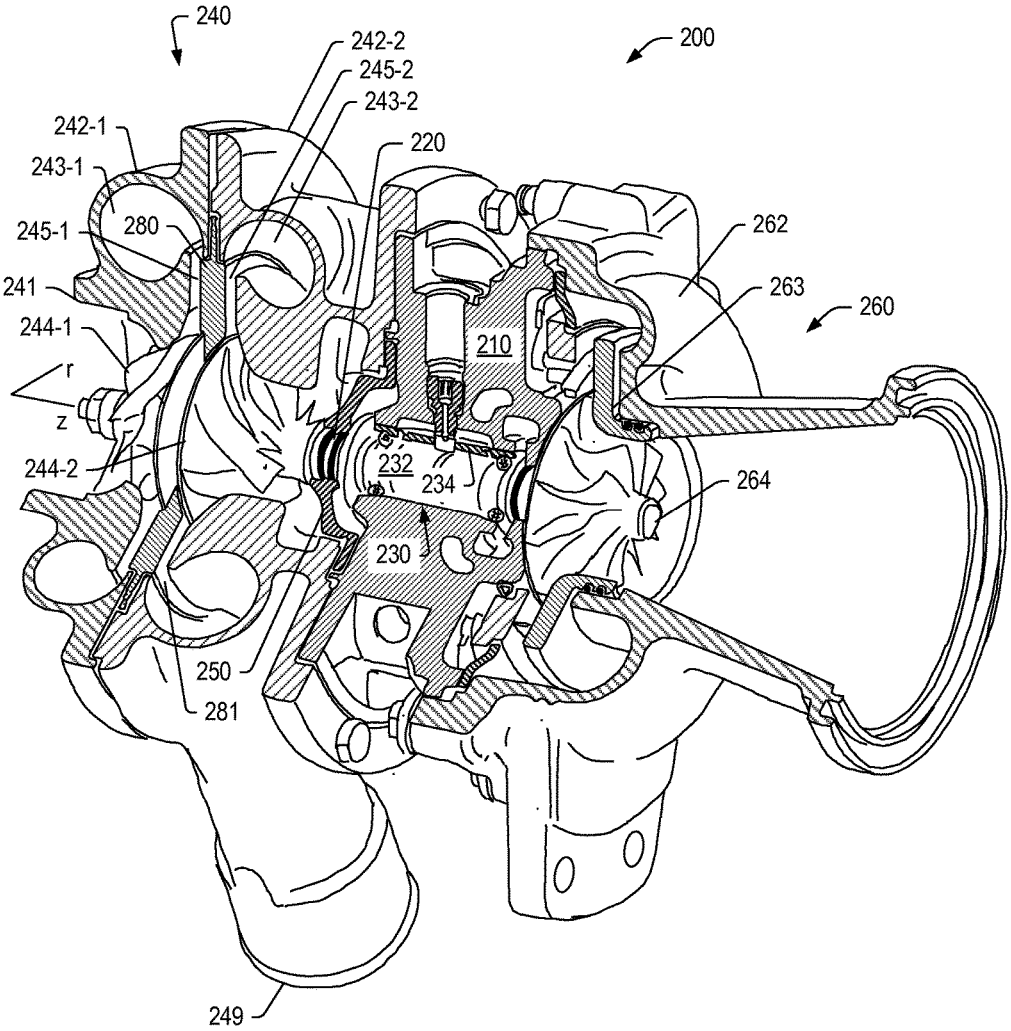
FIG. 2 is a cut-away view of an example of a turbocharger.

FIG. 2 shows an example of a turbocharger assembly 200 that includes a bearing housing 210 that supports a bearing assembly 230 in a through bore of the bearing housing 210 where the bearing assembly 230 may be or include a rolling element bearing assembly. For example, the bearing assembly 230 may be a bearing cartridge that includes an inner race 232 and an outer race 234 where rolling elements are disposed between an the inner race 232 and the outer race 234 and where a shaft 220 is operatively coupled to the inner race 232 such that rotation of the shaft 220 rotates the inner race 232. In such an example, the outer race 234 may be located with respect to the bearing housing 210 (e.g., via a locating mechanism, etc.). As an example, seal elements may be disposed about the shaft 220 (e.g., or a collar), for example, to reduce flow of air and/or exhaust to the bearing assembly 230. Such seal elements may also act to reduce flow of lubricant (e.g., in an opposite direction).

In the example of FIG. 2, the turbocharger assembly 200 includes a compressor assembly 240 that includes an inlet 241 that may be formed as part of a first compressor housing component 242-1 that can be operatively coupled to a second compressor housing component 242-2. As shown, the first compressor housing component 242-1 may define, at least in part, a first volute 243-1 and the second compressor housing component 242-2 may define, at least in part, a second volute 243-2. In the example of FIG. 2, a first compressor wheel 244-1 can direct gas (e.g., air, an air and exhaust mixture, etc.) to a first diffuser section 245-1 to the first volute 243-1 and the second compressor wheel can direct air to a second diffuser section 245-2 to the second volute 243-2. For example, the compressor wheels 244-1 and 244-2 may each include a respective inducer portion and a respective exducer portion where gas flows into the inducer portion and out of the exducer portion (e.g., to a respective diffuser section). As shown in the example of FIG. 2, the compressor wheels 244-1 and 244-2 are radial compressor wheels. As an example, a radial compressor may achieve a pressure rise by adding kinetic energy (e.g., velocity) to a flow of fluid (e.g., air, etc.) through a rotor (e.g., impeller or "wheel"). As an example, such kinetic energy may be converted to an increase in potential energy (e.g., static pressure), for example, by slowing the flow through a diffuser section.

In the example of FIG. 2, the turbocharger assembly 200 includes a turbine assembly 260 that includes a turbine housing component 262, an insert component 263, and a turbine wheel 264. As an example, the turbine assembly 260 may include a nozzle adjustment mechanism such as a variable geometry mechanism that can adjust positions of vanes, etc. that may define throats that direct exhaust gas to the turbine wheel 264. As an example, the turbine wheel 264 may be operatively coupled to the shaft 220. As an example, the turbine wheel 264 and the shaft may be a shaft and wheel assembly (SWA). In the example of FIG. 2, exhaust gas may flow to the turbine wheel 264 to cause the turbine wheel 264 to rotate and thereby rotate the shaft 220. In the example of FIG. 2, the first compressor wheel 244-1 and the second compressor wheel 244-2 are operatively coupled to the shaft 220 (e.g., via the shaft 220 being disposed in a through bore of the compressor wheels 244-1 and 244-2 and fitted with a nut or other mechanism at an nose end of the compressor wheel 244-1, via a partial bore or "boreless" dual-faced compressor wheel assembly, etc.). Thus, energy may be extracted from exhaust gas to cause rotation of the shaft 220 and rotation of the first compressor wheel 244-1 and the second compressor wheel 244-2. In such an example, gas (e.g., air, an air exhaust mixture, etc.) flowing into the compressor assembly 240 may be compressed and exit the compressor assembly 240 at an outlet 249, which may be, for example, a portion of the second compressor housing component 242-2.

While the example of FIG. 2 shows the turbine assembly 260 as a mechanism that can rotate the compressor wheels 244-1 and 244-2, compressor wheels of a compressor assembly such as the compressor assembly 240 of FIG. 2 may be driven by a different type of mechanism, additionally or alternatively. For example, an electric motor may be operatively coupled to a shaft to which the first compressor wheel 244-1 and the second compressor wheel 244-2 are operatively coupled. In such an example, electrical power may be supplied to the electric motor to rotatably drive the shaft and hence the compressor wheels 244-1 and 244-2. In such an example, a bearing housing may be implemented, optionally as part of an electric motor assembly (e.g., consider a motor housing that houses a stator and a rotor coupled to a shaft where the motor housing includes one or more bearings, bearing assemblies, etc. to rotatably support the shaft).

In the example of FIG. 2, a baffle 280 exists that includes an outer surface 281 where a portion of the outer surface 281 defines in part the first diffuser section 245-1 and where another portion of the outer surface 281 defines in part the second diffuser section 245-2. As an example, the first compressor wheel 244-1, the first diffuser section 245-1 and the first volute 243-1 may operate at a lower pressure than the second compressor wheel 244-2, the second diffuser section 245-2 and the second volute 243-2. In such an example, gas (e.g., air, an air exhaust mixture, etc.) may flow into the compressor assembly 240 via the inlet 241, be compressed by the first compressor wheel 244-1 and then flow to the second compressor wheel 244-2 where it is further compressed and directed to the outlet 249. In such an example, the compressor assembly 240 may be referred to as a two stage compressor assembly with a first, low pressure stage and a second, high pressure stage.

In such a two stage arrangement, during operation, gas pressure in the first diffuser section 245-1 may be expected to be less than gas pressure in the second diffuser section 245-2. In such an example, gas may flow from the second diffuser section 245-2 to the first diffuser section 245-1. Such flow may decrease efficiency of operation of the compressor assembly 240. As another example, such flow may act to increase the temperature of gas flowing in the first diffuser section 245-1, which, in turn, may act to increase the temperature of gas flowing to the inducer portion of the second compressor wheel 244-2 and thereby diminish the overall effect of the second stage.

In a compressor assembly such as the compressor assembly 240, it is desirable to isolate the work of the first compressor wheel 244-1 as gas flows from the inducer portion to the exducer portion and into the first diffuser section 245-1 and to isolate the work of the second compressor wheel 244-2 as gas flows from the inducer portion to the exducer portion and into the second diffuser section 245-2. However, the baffle 280 may, with respect to hub portions of the compressor wheels 244-1 and 244-2, define a somewhat annular, V-shaped passage where gas may flow from a higher pressure region to a lower pressure region. Specifically, during operation of a two stage compressor assembly, gas may flow from a region of the high pressure stage to a region of the low pressure stage via such a passage. For example, consider a portion of the gas compressed by the second compressor wheel 244-2 flowing to a region adjacent the hub portion of the first compressor wheel 244-1. In such an example, that portion of the gas does not directly enter the second diffuser section 245-2. Such a phenomenon may be referred to as "interstage leakage". As an example, interstage leakage may decrease overall compressor stage efficiency.

As an example, the outer surface 281 of the baffle 280 may include a shape or shapes that act to reduce interstage leakage. As an example, the hub portion of at least one of the compressor wheels 244-1 and 244-2 may include a shape or shapes that act to reduce interstage leakage. As an example, a baffle and a hub portion or hub portions may include shapes that act to reduce interstage leakage. As an example, a shape or a shapes may define a labyrinth of a passage where the labyrinth acts to reduce interstage leakage. As an example, a shape or shapes may define at least in part a passage that causes the flow of gas therethrough to bend and, for example, optionally form eddies. In such an example, eddies may be "energy extractors" that cause flow adjacent thereto to slow down.

Figure 3:
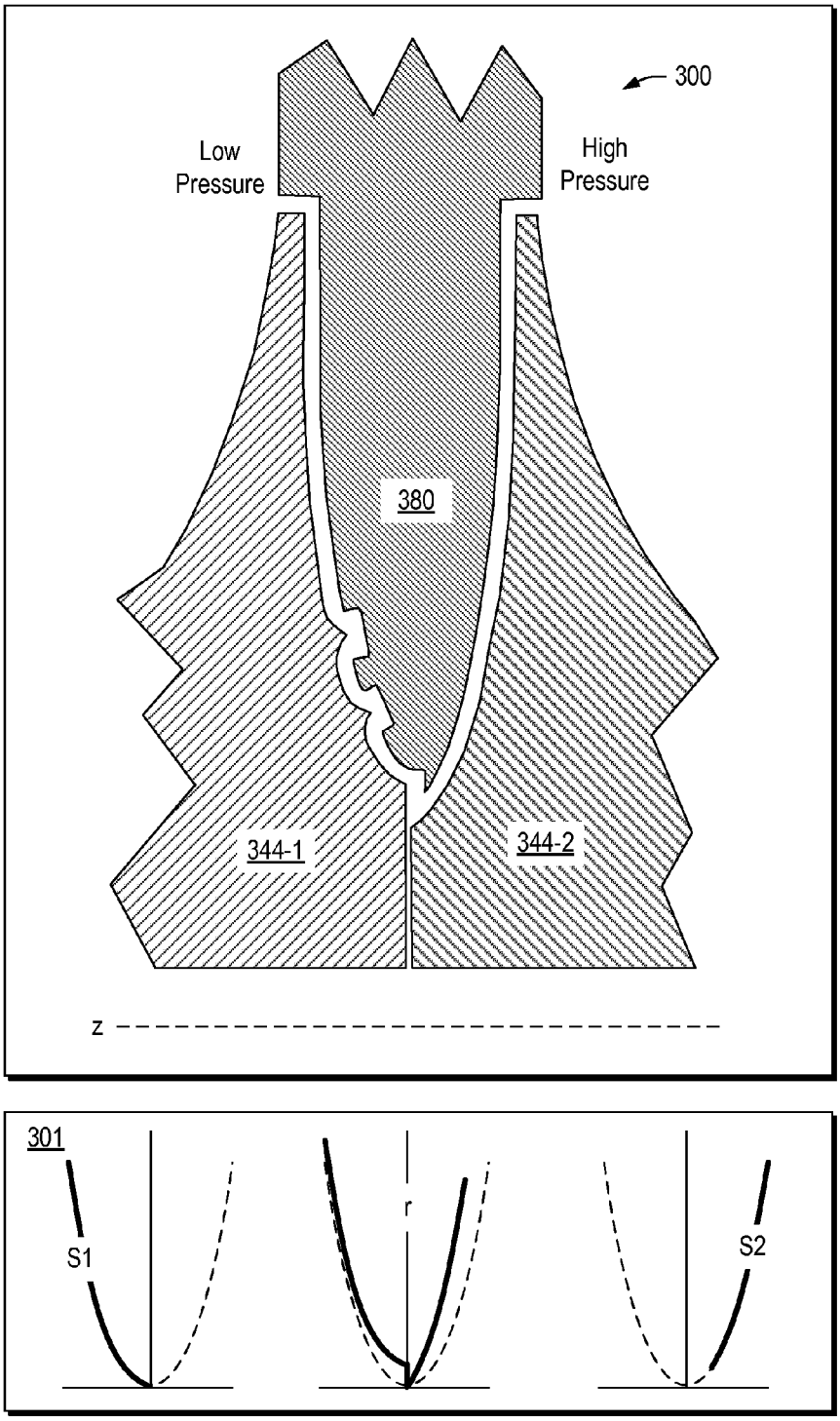
FIG. 3 is a cross-sectional view of an example of a portion of an assembly that includes an example of a baffle and a series of plots.

FIG. 3 shows an example of a portion of a compressor assembly that includes a first compressor wheel 344-1, a second compressor wheel 344-2 and a baffle 380 that is disposed at least in part partially between a hub portion of the first compressor wheel 344-1 and a hub portion of the second compressor wheel 344-2. In the example of FIG. 3, the second compressor wheel 344-2 may be considered a high pressure stage compressor wheel while the first compressor wheel 344-1 may be considered a low pressure stage compressor wheel. As shown in the example of FIG. 3, a passage is defined where the passage includes a labyrinth portion, which may be considered to be a low pressure side labyrinth portion because it is defined in part by features of the baffle 380 that face the hub portion of the first compressor wheel 344-1. In the example of FIG. 3, the hub portion of the first compressor wheel 344-1 and a low pressure facing portion of an outer surface of the baffle 380 define the low pressure side labyrinth portion of the passage.

FIG. 3 also shows a series of plots 301 that include a plot of a first surface shape (S1), a plot of a second surface shape (S2) and a plot of a shape that includes the first surface shape (S1) and the second surface shape (S2).

As an example, an annular baffle for a two stage radial compressor assembly can include an outer edge; and a substantially parabolic portion that includes an inner edge that defines an opening having a central axis and opposing surfaces that extend from the inner edge. In such an example, one of the opposing surfaces may include an annular notch adjacent to the inner edge, for example, where the annular notch is defined in part by a radial notch width. As illustrated in the series of plots 301, one of the opposing surfaces of the baffle 380 may include a first substantially semi-parabolic shape (e.g., S1) and the other of the opposing surfaces may include a second substantially semi-parabolic shape (e.g., S2). In such an example, a radial offset (see, e.g., r-axis) between ends of the opposing surfaces may define a radial notch width. As an example, an annular notch may include an annular axial face.

As shown in FIG. 3, a surface of the baffle 380 can include an annular channel, for example, an annular channel located radially outwardly from an annular notch. As an example, a surface of a baffle may include one or more annular channels.

Figure 4:
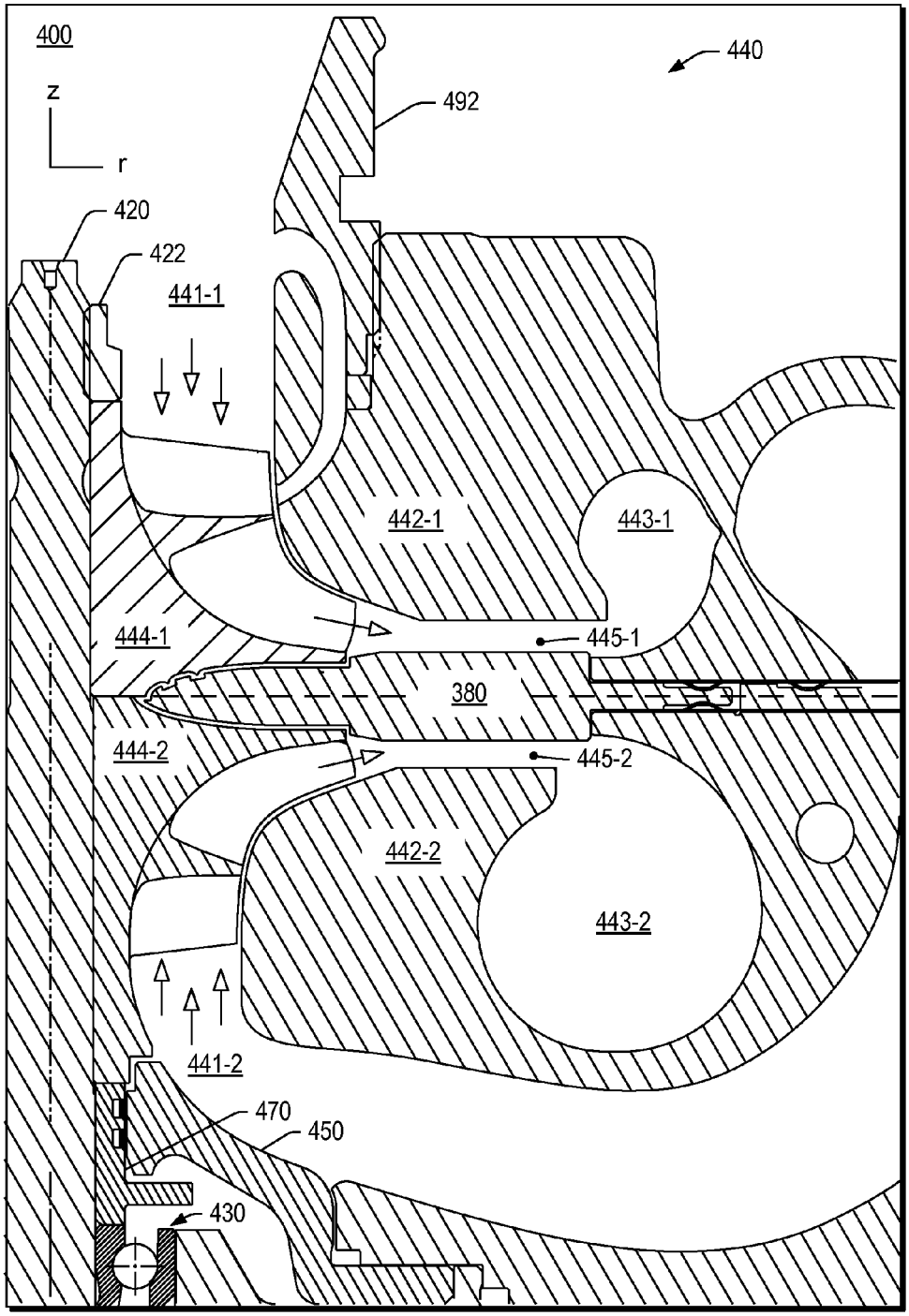
FIG. 4 is a cross-sectional view of a portion of an assembly that includes the baffle of FIG. 3.

FIG. 4 shows a cross-sectional view of a portion of an assembly 400 that includes a compressor assembly 440 operatively coupled to a component 450 of a center housing that includes a bearing assembly 430 that rotatably supports a shaft 420 to which a nut 422 axially locates a first compressor wheel 444-1 and a second compressor wheel 444-2 with respect to a collar 470. As shown, the baffle 380 is disposed in part in a space defined by a hub surface of the first compressor wheel 444-1 and a hub surface of the second compressor wheel 444-2 and the baffle 380 is disposed in part between a first compressor housing component 442-1 and a second compressor housing component 442-2.

In the example of FIG. 4, a surface of the baffle 380 forms a diffuser section 445-1 with a surface of the first compressor housing component 442-1 where the diffuser section 445-1 is in fluid communication with a volute 443-1 while another surface of the baffle 380 forms a diffuser section 445-2 with a surface of the second compressor housing component 442-2 where the diffuser section 445-2 is in fluid communication with a volute 443-2. As an example, the first and second compressor housing components 442-1 and 442-2 may be operatively coupled (e.g., clamped, etc.) to locate the baffle 380 (e.g., radially and/or axially, for example, to maintain the baffle 380 in a stationary manner with respect to the housing components 442-1 and 442-2).

In the example of FIG. 4, from a lower axial position to an upper axial position, the assembly 400 includes an inner race of the bearing assembly 430 that can contact an axial face of the collar 470 that can contact an axial end face of the second compressor wheel 444-2. As shown, an axial face at a hub end of the second compressor wheel 444-2 can contact an axial face at a hub end of the first compressor wheel 444-1 where the nut 422 (e.g., or other component) may be received by the shaft 420 to locate the compressor wheels 444-1 and 444-2 axially on the shaft 420. For example, the nut 422 may be tightened (e.g., to a torque specification) to apply a compressive force to the first and second compressor wheels 444-1 and 444-2 (e.g., with respect to the collar 470, etc.).

In the example of FIG. 4, the shaft 420 may be rotatably driven (e.g., by a turbine, an electric motor, etc.) such that, for example, air flows into the compressor assembly 440 via an opening 441-1. In the example of FIG. 4, the opening 441-1 may be defined in part by a compressor housing inlet component 492, which may form, for example, a portion of a recirculation passage (e.g., together with the first compressor housing component 442-1).

In the example of FIG. 4, the compressor assembly 440 includes two stages, a first stage (e.g., a low pressure stage) formed by the first compressor wheel 444-1, the first compressor housing component 442-1 and the baffle 380 and a second stage (e.g., a high pressure stage) formed by the second compressor wheel 444-2, the second compressor housing component 442-2 and the baffle 380. Directions of fluid flow are indicated by open headed arrows where fluid (e.g., air or air and exhaust) flows axially inwardly to an inducer portion of the first compressor wheel 444-1 and radially outwardly from an exducer portion of the first compressor wheel 444-1 to the diffuser section 445-1. Fluid in the diffuser section 445-1 then flows to the volute 443-1 and on to the inlet 441-2 to the inducer portion of the second compressor wheel 444-2. As shown, fluid flows from the inducer portion of the second compressor wheel 444-2 to an exducer portion of the second compressor wheel 444-2 and then to the diffuser section 445-2. Fluid in the diffuser section 445-2 then flows to the volute 443-2 and on to a conduit that is in fluid communication with an intake (e.g., an intake manifold) of an internal combustion engine.

Various features of the assembly 400 of FIG. 4 may be described and, for example, defined with respect to a cylindrical coordinate system. For example, consider an r, z, and Θ coordinate system where z is along an axis of rotation of the shaft 420, which may coincide with an axis of the first and second compressor housing components 442-1 and 442-2.

As an example, efficiency of the compressor assembly 440 may depend on an ability to hinder undesirable flow of fluid from the second stage to the first stage. In the example of FIG. 4, the baffle 380 and, for example, the shape of a hub surface or hub surfaces of one or both of the compressor wheels 444-1 and 444-2 may act to hinder undesirable flow of fluid from the second stage to the first stage.

Figure 5:
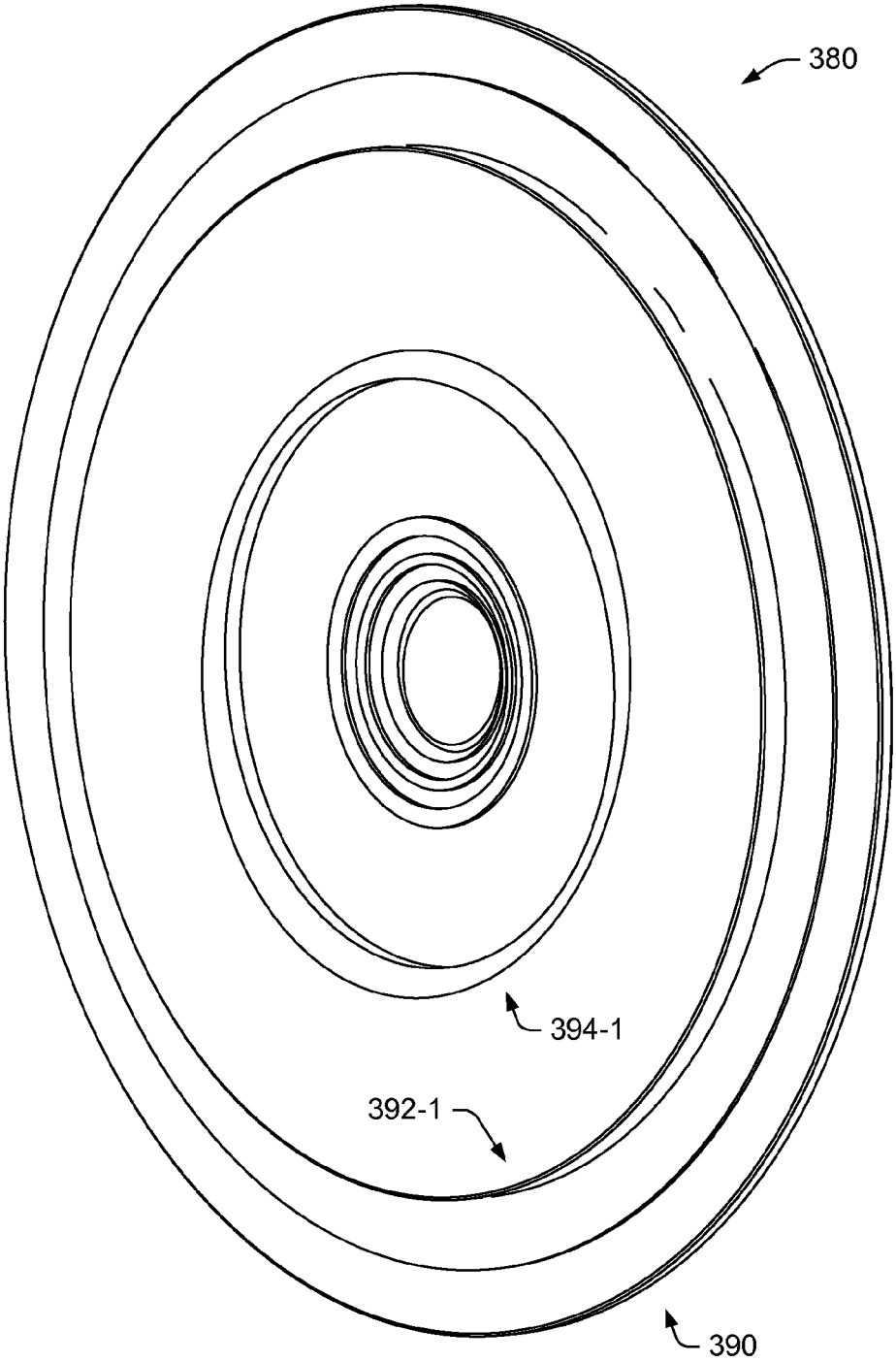
FIG. 5 is a perspective view of the baffle of FIG. 3.

FIG. 5 shows a perspective view of the baffle 380 of FIG. 4 with its first stage (e.g., low pressure stage) face visible along with, for example, an outermost edge 390, a locating step 392-1 and a compressor wheel step 394-1 (e.g., features that may be optional, of other shape(s), etc.).

Figure 6:
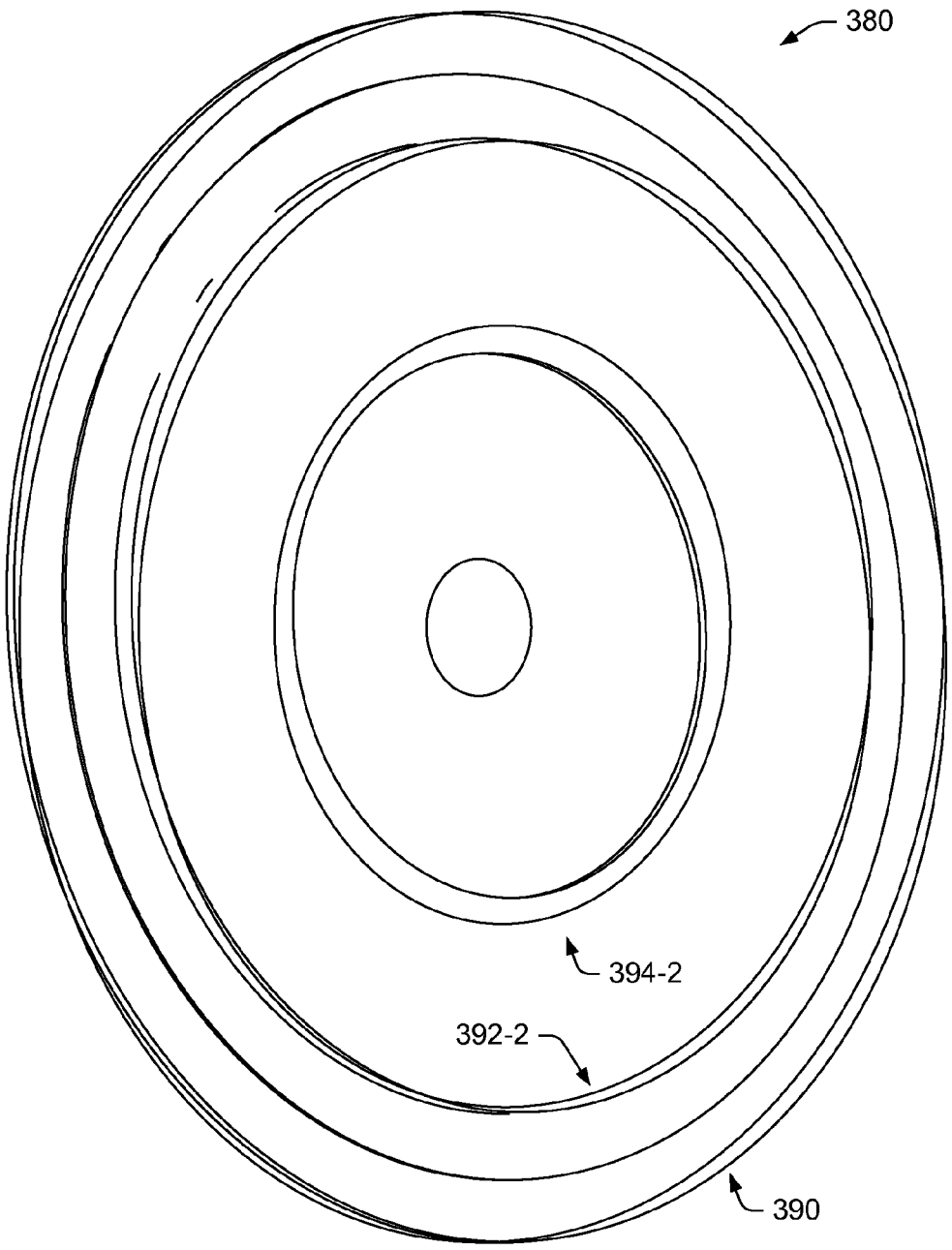
FIG. 6 is a perspective view of the baffle of FIG. 3.

FIG. 6 shows a perspective view of the baffle 380 of FIG. 4 with its second stage (e.g., high pressure stage) face visible along with, for example, the outermost edge 390, a locating step 392-2 and a compressor wheel step 394-2 (e.g., features that may be optional, of other shape(s), etc.).

As shown in FIG. 5, in comparison to FIG. 6, the first stage face includes features proximate to an innermost diameter of the baffle 380. As an example, dimensions, shape(s), etc. of one or both of the compressor wheel steps 394-1 and 394-2, if present, may act to hinder flow from a high pressure stage to a low pressure stage. As an example, a compressor wheel step may define a radial clearance with an outermost diameter of a compressor wheel and an axial clearance with a hub surface of a compressor wheel.

Figure 7:
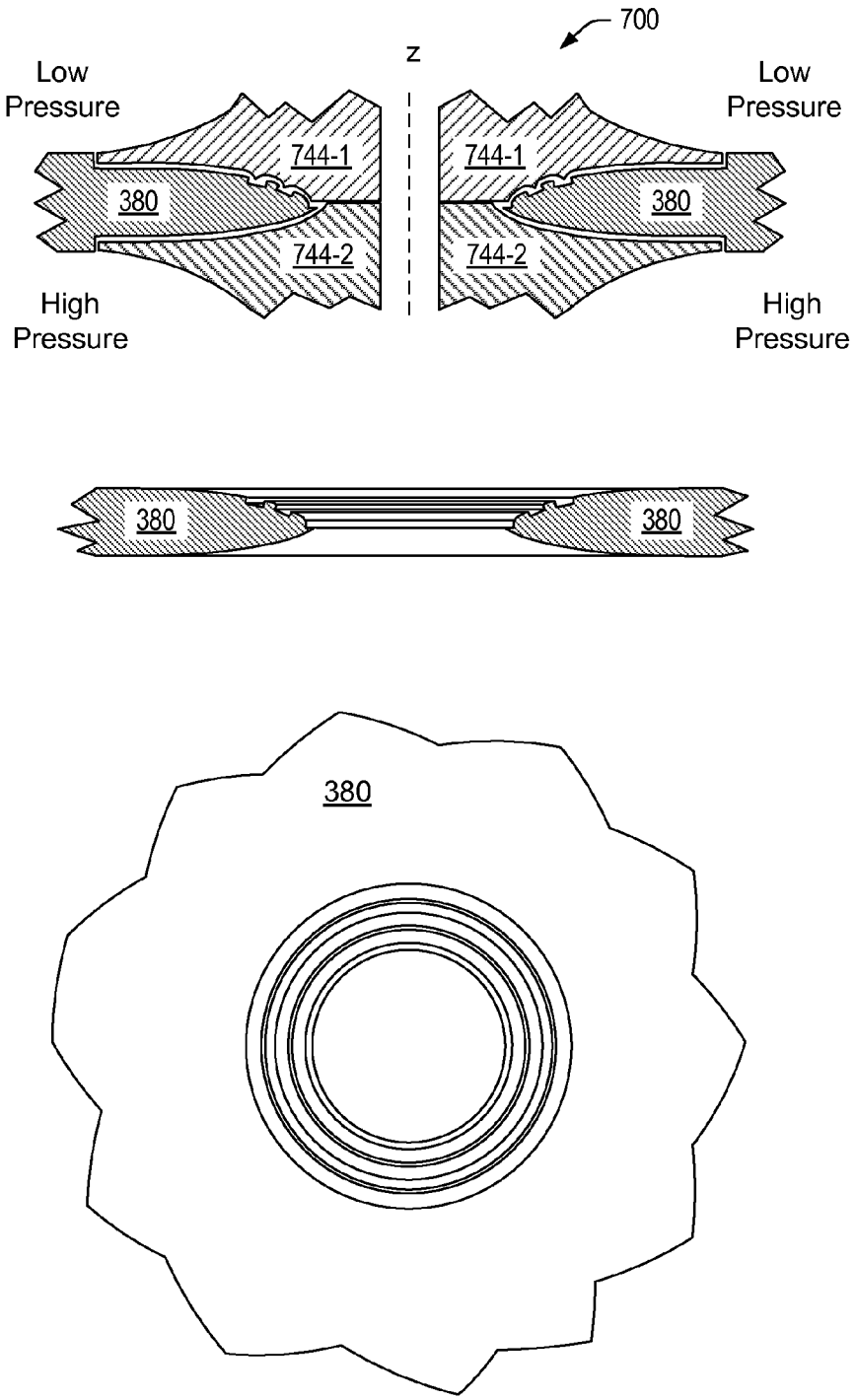
FIG. 7 is a series of views of portions of the assembly of FIG. 3.

FIG. 7 shows a series of views of a portion of an assembly 700 that includes a first compressor wheel 744-1, a second compressor wheel 744-2 and the baffle 380. FIG. 7 includes a plan view that illustrates how the features of the baffle 380 may be formed as features of particular radii, which may be relatively constant about a central axis of the baffle 380.

As an example, the features may vary with respect to azimuthal angle about the central axis of the baffle 380. For example, consider undulating or "wavy" features where radii of a particular feature may vary with respect to azimuthal angle. In such an example, as the compressor wheel 744-1 is rotating (e.g., about an axis aligned with the central axis of the baffle 380), undulating or wavy features may be of sufficient dimensions to accommodate a feature or features that may exist on the hub portion of the compressor wheel 744-1. For example, where a feature of one component extends into a feature of another component, clearances may exist such that upon rotation of a compressor wheel contact does not occur between the compressor wheel and a baffle. As an example, shapes of feature may be formed to generate an "anti-pumping" effect. For example, consider features that act to redirect flow toward a source rather than toward a sink. As an example, an eddy may be formed that at least in part redirects a velocity component of gas flow in a direction opposite to a source of the gas flow.

Figure 8:
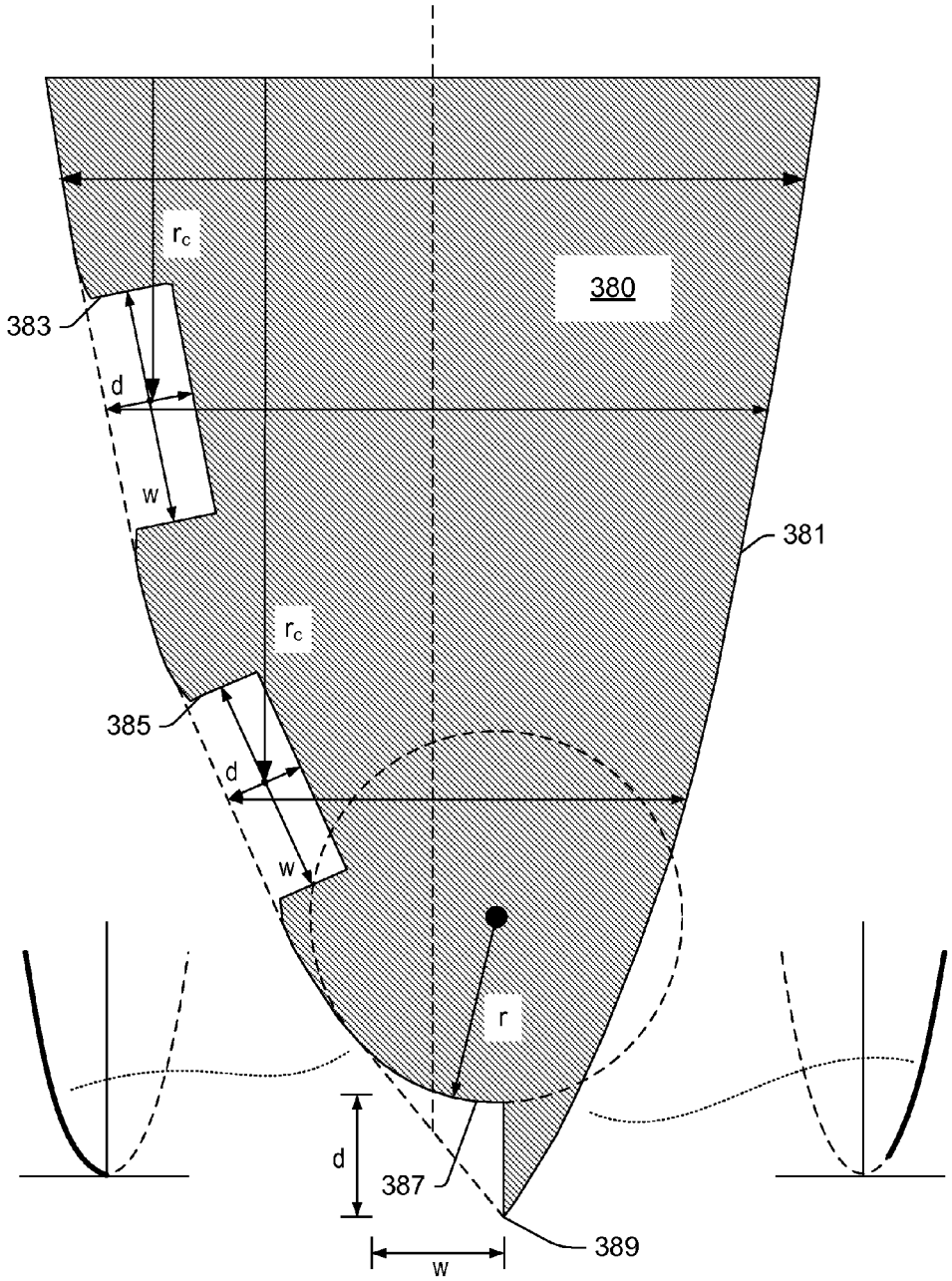
FIG. 8 is an enlarged cross-sectional view of a portion of the baffle of FIG. 3.

FIG. 8 shows an enlarged view of a portion of the baffle 380. As shown in FIG. 8, the baffle 380 includes an outer surface 381 that includes a portion generally facing to the right (see, e.g., the perspective view of FIG. 5) and a portion generally facing to the left (see, e.g., the perspective view of FIG. 6). The portion of the outer surface 381 facing to the right may define a portion of a passage with respect to a surface of a hub portion of a compressor wheel and the portion of the outer surface 381 facing to the left may define a portion of the passage with respect to a surface of a hub portion of another compressor wheel.

In the example of FIG. 8, the baffle 380 includes a first annular channel 383, a second annular channel 385 and an annular notch 387 adjacent to an end 389 of the baffle 380. As an example, the annular channels 383 and 385 may each be defined by channel dimensions such as, for example, a channel depth (e.g., d), a channel width (e.g., w) and a channel radius (e.g., $r_c$). As an example, the annular notch 387 may be defined by notch dimensions such as, for example, a notch depth (e.g., d) and a notch width (e.g., w) with respect to the end 389 of the baffle 380. As shown, a notch may be defined in part by a radius of curvature, for example, as a portion of a torus (e.g., a donut shape) that may be defined by a major radius (e.g., center of "tube" to center of the torus) and a minor radius (e.g., radius of the "tube", as shown as "r" in FIG. 8).

Figure 9:
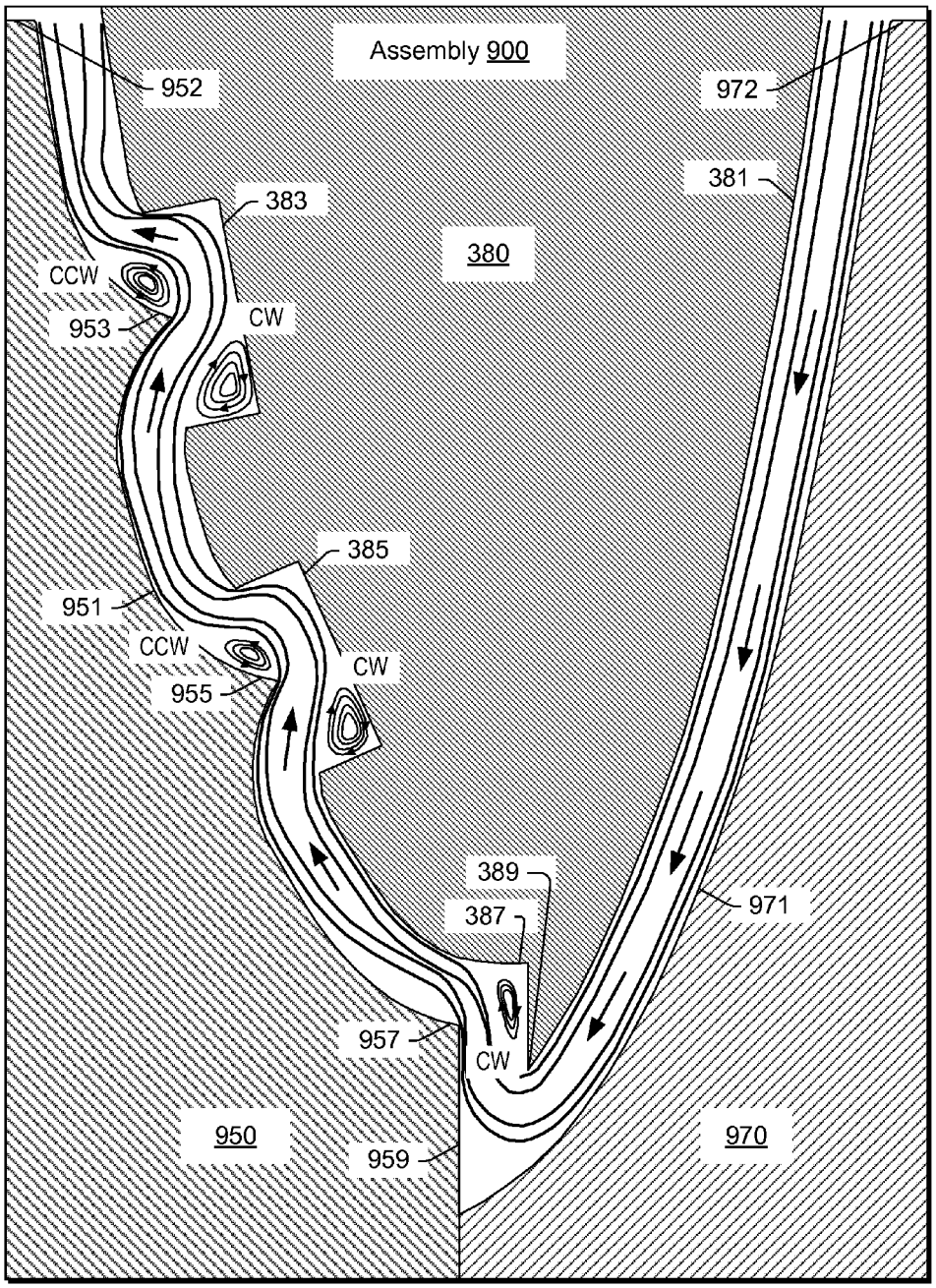
FIG. 9 is a cross-sectional view of a portion of the assembly that illustrates flow in a passage defined in part by the baffle of FIG. 3.

FIG. 9 shows examples of approximate streamlines of fluid in the passage formed at least in part by the baffle 380 as part of an example of an assembly 900 that includes a compressor wheel 950 and a compressor wheel 970. As shown in the example assembly 900, the compressor wheel 950 includes a hub portion with a surface 951 that includes a first annular cusp 953, a second annular cusp 955, an annular corner 957 and an annular face 959 and the compressor wheel 970 includes a hub portion with a surface 971.

As an example, an annular cusp may be a feature formed by two annular curved surfaces that meet. As an example, an annular cusp may include a maximum defined by an annular line or, for example, by an annular surface. As an example, a hub surface of a compressor wheel may include a feature that extends outwardly away from the hub surface where such a feature may be, in cross-section, for example, a cusp. As an example, a feature of a hub surface of a compressor wheel may be a ridge. As an example, an annular cusp may be a ridge. As an example, a ridge may be formed in part by one or more curved surfaces.

As shown in FIG. 9, for a given overall direction of flow (see large arrows), annular eddies are formed, which can include one or more clockwise rotating eddies and one or more counter-clockwise rotating eddies. For example, three clockwise (CW) rotating eddies are shown and two counter-clockwise (CCW) rotating eddies are shown.

In the example of FIG. 9, the streamlines and eddies are approximate as flow between a stationary surface (e.g., of the baffle 380) and rotating surfaces (e.g., of the compressor wheels 950 and 970) may form Couette types of flows as may exist between parallel plates, one of which is moving relative to the other. Further, such flow may be turbulent given the rotational speed of the compressor wheels 950 and 970 may be of the order of tens of thousands of revolutions per minute (rpm) and as much as 100,000 rpm or more. Thus, flow may be complex and include pressure driven flow (e.g., as a driving force from a high pressure region to a low pressure region) and Couette type of flow, which may be turbulent (e.g., noting that the term "Couette type" is to indicate that flow may or may not be laminar).

As an example, a baffle can include one or more annular channels. As an example, a hub surface of a compressor wheel can include one or more annular features such as, for example, one or more annular cusps. As an example, an assembly can include a baffle with a single annular channel and a compressor wheel that includes a single annular cusp (see, e.g., the channel 383 and the cusp 953 or the channel 385 and the cusp 955). In such an example, the baffle may include a notch (see, e.g., the notch 387). As an example, an assembly can include a baffle with one or more annular channels and a compressor wheel that includes one or more annular cusps (see, e.g., the channel 383 and the cusp 953 and/or the channel 385 and the cusp 955). In such an example, the baffle may include a notch (see, e.g., the notch 387).

As an example, interstage leakage may act to decrease overall compressor stage efficiency. As an example, an assembly that includes an annular baffle that includes one or more features such as one or more of those of the baffle 380 of FIG. 9 may act to reduce interstage leakage between compressor stages. In such an example, one or more compressor wheels may include, for example, one or more of the features of the compressor wheels 950 and 970 of FIG. 9. As an example, a turbocharger can include multi-stage compressor with a high pressure (HP) stage and a low pressure (LP) stage and can include a baffle where the baffle may act to define a space with respect to a HP stage wheel and a LP stage wheel where the baffle can act to reduce leakage via the space. In such an example, one or more of the wheels may include one or more features that may act to, in part, define the space and to reduce leakage via the space.

As an example, a multi-stage compressor may include one or more variable diffuser mechanisms that can, for example, alter geometry of a diffuser section. As an example, a turbocharger may include a variable geometry turbine assembly that may include, for example, adjustable vanes (e.g., that can alter throat size, shape, etc.). As an example, a turbocharger may include a variable geometry multi-stage compressor assembly and a variable geometry turbine assembly.

The new design decreases the leakage effectively with help of labyrinths where the corresponding flow is forced to bend.

Figure 10:
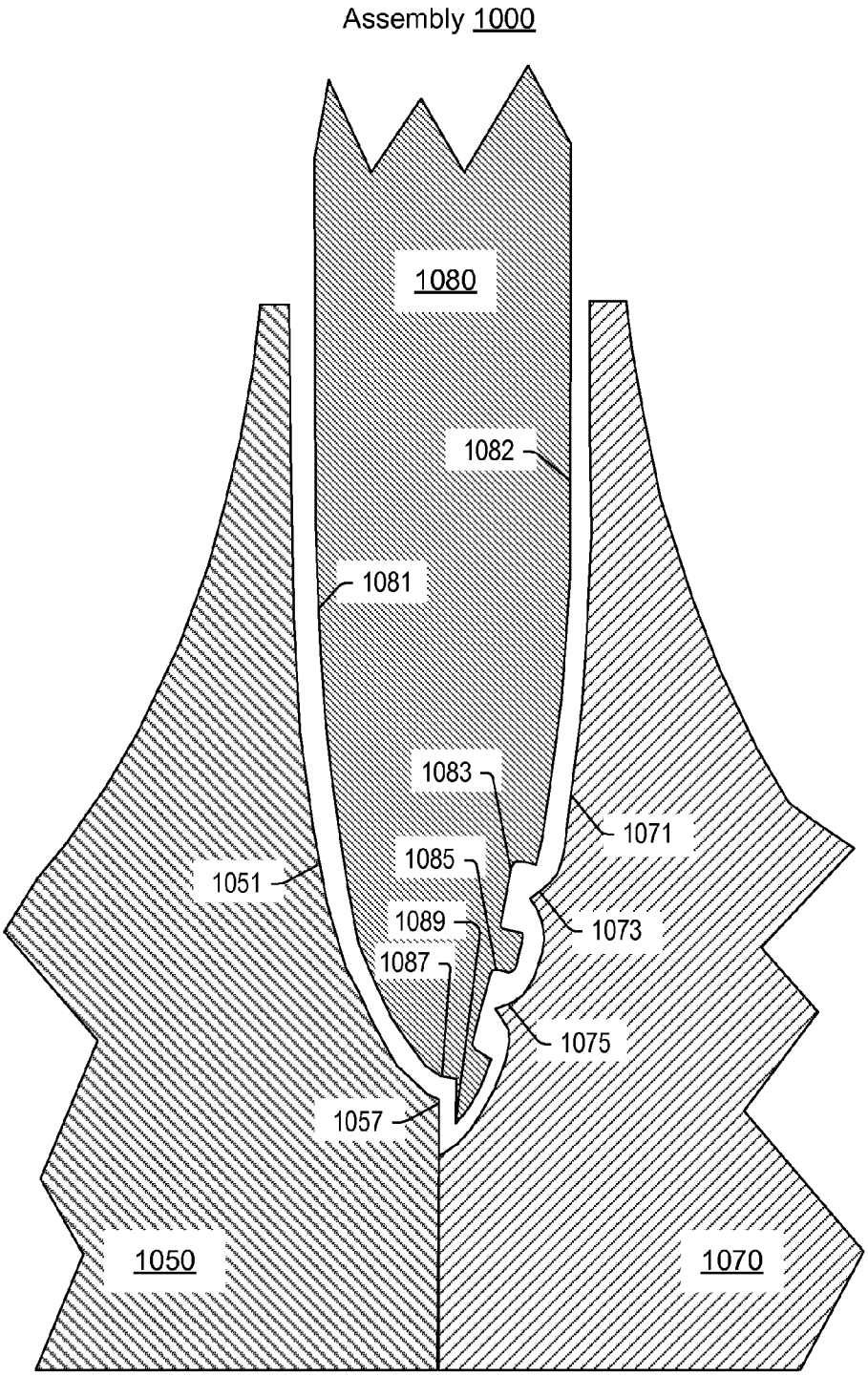
FIG. 10 is a cross-sectional view of a portion of an example of an assembly.

FIG. 10 shows an example of a portion of a multistage compressor assembly 1000 that includes a baffle 1080, a first compressor wheel 1050 and a second compressor wheel 1070. In the example of FIG. 10, the first compressor wheel 1050 may be part of a low pressure stage of the multistage compressor assembly 1000 and the second compressor wheel 1070 may be part of a high pressure stage of the multistage compressor assembly 1000. As shown, the baffle 1080 includes two annular channels 1083 and 1085 that face a hub surface 1071 of the second compressor wheel 1070, which includes two annular ridges 1073 and 1075. In the example of FIG. 10, the baffle 1080 also includes an end notch 1087 and an end 1087 (e.g., that defines a minimum diameter of an opening of the baffle 1080). The baffle 1080 is also shown as including a surface 1081 that faces a hub surface 1051 of the first compressor wheel 1050 where the hub surface 1051 extends to a corner 1057.

Figure 11:
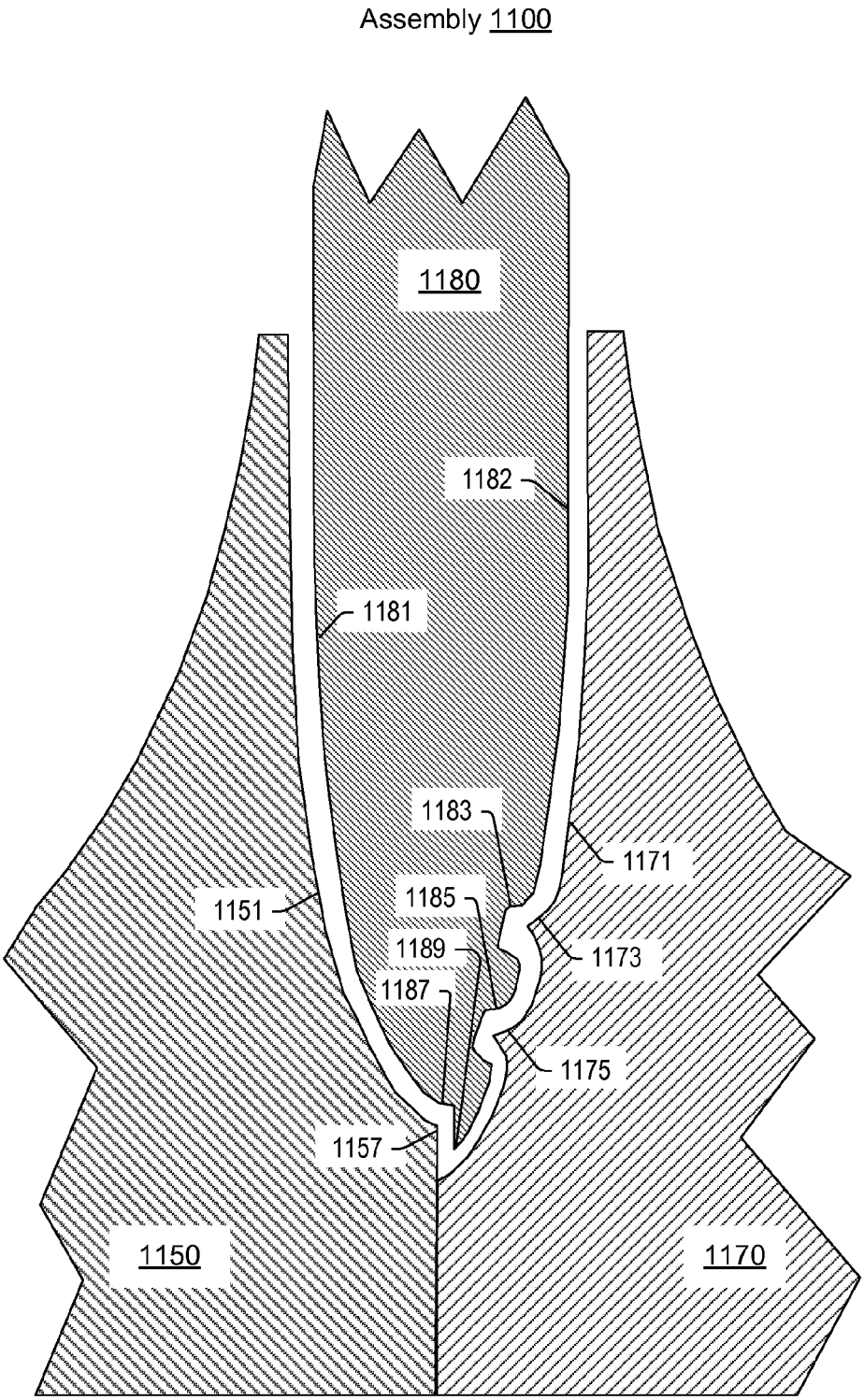
FIG. 11 is a cross-sectional view of a portion of an example of an assembly.

FIG. 11 shows an example of a portion of a multistage compressor assembly 1100 that includes a baffle 1180, a first compressor wheel 1150 and a second compressor wheel 1170. In the example of FIG. 11, the first compressor wheel 1150 may be part of a low pressure stage of the multistage compressor assembly 1100 and the second compressor wheel 1170 may be part of a high pressure stage of the multistage compressor assembly 1100. As shown, the baffle 1180 includes two annular channels 1183 and 1185 that face a hub surface 1171 of the second compressor wheel 1170, which includes two annular ridges 1173 and 1175. In the example of FIG. 11, the baffle 1180 also includes an end notch 1187 and an end 1187 (e.g., that defines a minimum diameter of an opening of the baffle 1180). The baffle 1180 is also shown as including a surface 1181 that faces a hub surface 1151 of the first compressor wheel 1150 where the hub surface 1151 extends to a corner 1157. In comparison to the assembly 1000 of FIG. 10, the baffle 1180 includes annular channels of smaller channel widths than the annular channels of the baffle 1080.

Figure 12:
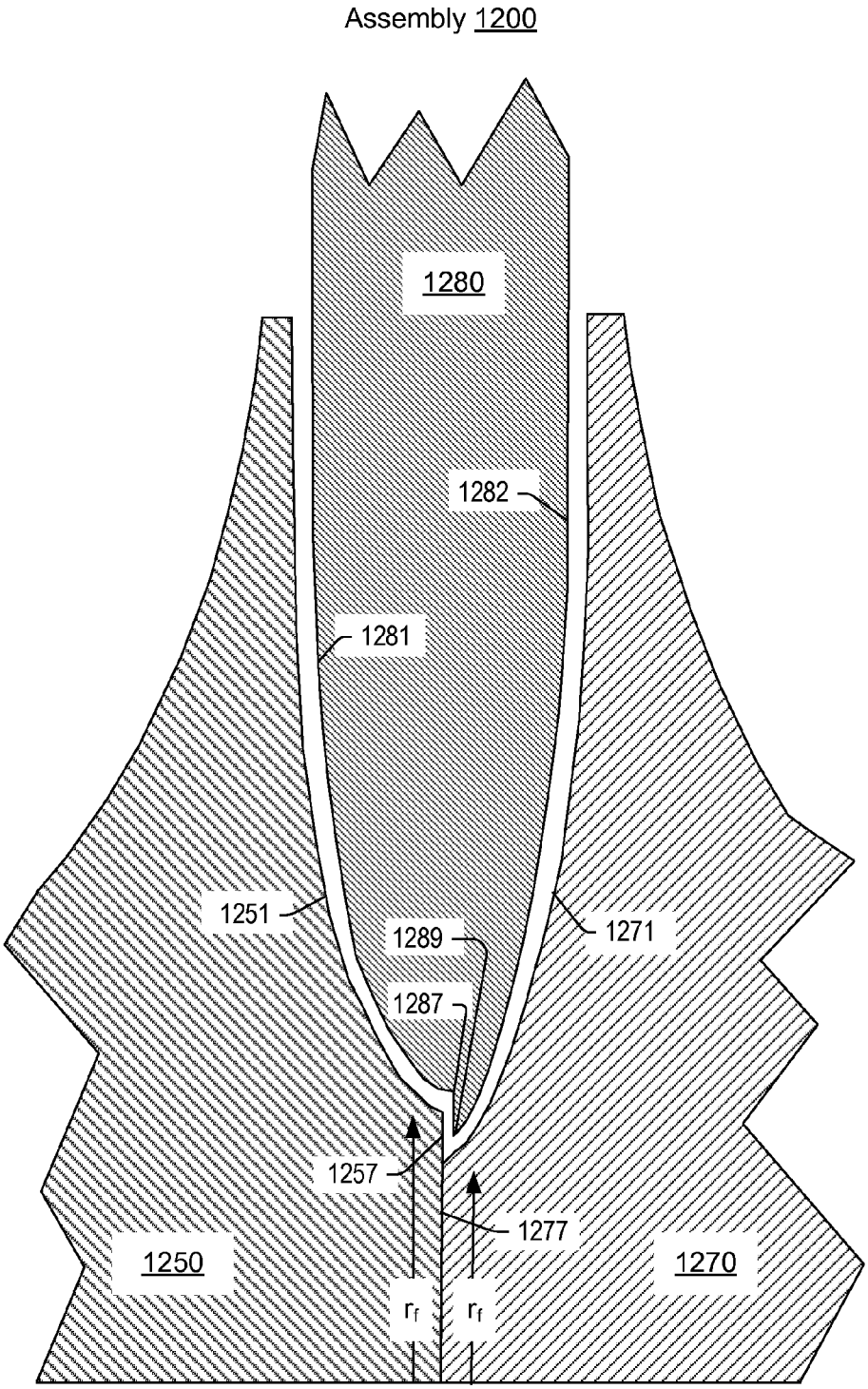
FIG. 12 is a cross-sectional view of a portion of an example of an assembly.

FIG. 12 shows an example of a portion of a multistage compressor assembly 1200 that includes a baffle 1280, a first compressor wheel 1250 and a second compressor wheel 1270. As shown in the example of FIG. 12, the baffle 1280 includes surfaces 1281 and 1282, an end notch 1287 and an end 1289 (e.g., that defines a minimum diameter of an opening of the baffle 1280), the first compressor wheel 1250 includes a hub surface 1251 and an axial face 1257 and the second compressor wheel 1270 includes a hub surface 1271 and an axial face 1277. As shown, the end notch 1287 includes an axial annular face that faces the axial face 1257 of the first compressor wheel 1250. As an example, the axial faces 1257 and 1277 may be in contact or, for example, a spacer may be positioned between the compressor wheels 1250 and 1270. In the example of FIG. 12, radii $r_f$ are shown, which may be radii that at least in part define the axial faces 1257 and 1277. In the example of FIG. 12, the compressor wheel 1250 may be a low pressure stage compressor wheel and the compressor wheel 1270 may be a high pressure stage compressor wheel or, for example, the compressor wheel 1250 may be a high pressure stage compressor wheel and the compressor wheel 1270 may be a low pressure stage compressor wheel. Thus, an end notch may, for example, face an axial face of a low pressure stage compressor wheel or face an axial face of a high pressure stage compressor wheel.

As an example, a hub surface of a compressor wheel may be shaped in a manner that can accommodate stresses. As mentioned, a compressor wheel may rotate at speeds in excess of 100,000 revolutions per minute. At such speeds, the compressor wheel can experience considerable stress. In an effort to avoid wheel burst (e.g., blade and/or hub), various portions of a compressor wheel may be shaped in manners that can accommodate stresses. One type of burst is blade burst, which occurs when the centrifugal force at speed acting to pull the blades off of the central hub overcomes the mechanical strength of the root sections connecting the individual blades to the hub. Under such conditions, if a blade root is too weak, it could detach from the hub. Another type of burst is hub burst, which occurs when the hub to which the blades are attached reaches a strength limit and, for example, breaks into two, three or more pieces (e.g., through the centerline of the wheel). As an example, a hub may be formed as a continuous mass where, upon rotation, internal stresses are maximal at the hub's core (e.g., portion that forms a bore). A lower hub surface may be shaped from a core portion to an end to provide for core mass and less mass at the end.

A shape of a hub surface may be curved in a manner that can accommodate stress. As an example, a shape of a hub surface of a compressor wheel may be, in cross-section, a shape of half a parabola (e.g., a parabolic shape). As an example, a baffle may be shaped with a surface that matches at least a portion of a hub surface of a compressor wheel. In such an example, a relatively constant axial clearance may exist with respect to radial distance between the baffle and the compressor wheel.

As an example, a baffle may be formed of a material such as steel. As an example, a baffle may be formed of an alloy. As an example, a baffle may be coated with a coating. As an example, a coating may resist chemical attack of a baffle core material. For example, consider a multistage compressor assembly implemented in a system that can include exhaust gas recirculation (EGR). In such an example, a coating may resist chemical attack by one or more components in exhaust gas of an internal combustion engine (e.g., which may react with one or more components in intake air, etc.).

As an example, a multistage compressor assembly may include compressors wheels made of the same material or compressor wheels made of different materials. As an example, a compressor wheel may be made of aluminum or an aluminum-base alloy.

Figure 13:
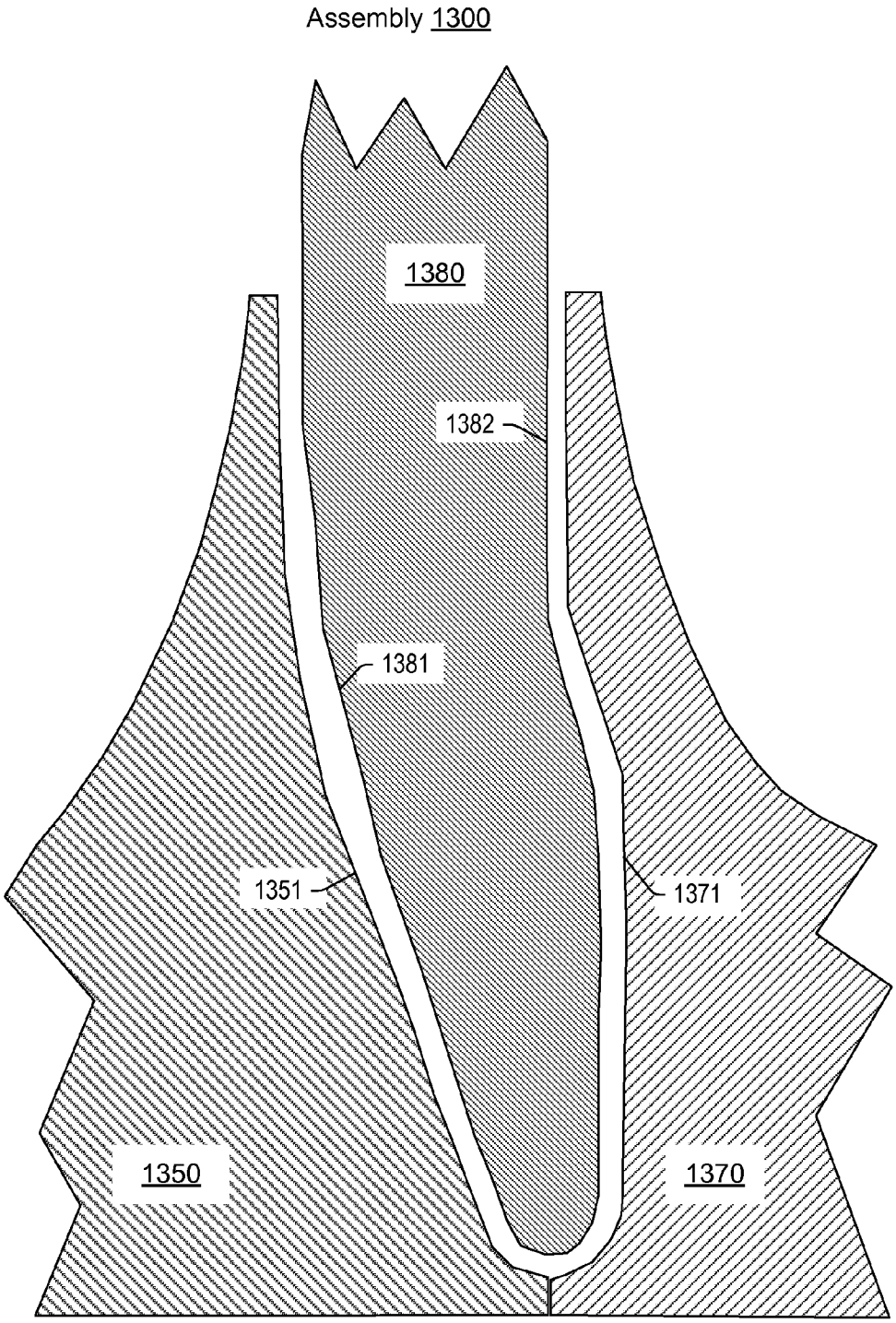
FIG. 13 is a cross-sectional view of a portion of an example of an assembly.

FIG. 13 shows an example of a portion of a multistage compressor assembly 1300 that includes a baffle 1380, a first compressor wheel 1350 and a second compressor wheel 1370. In the cross-sectional view of FIG. 13, the baffle 1380 has a continuous curved surface with portions 1381 and 1382 that match respective hub surfaces 1351 and 1371 of the compressor wheels 1350 and 1370, respectively.

Figure 14:
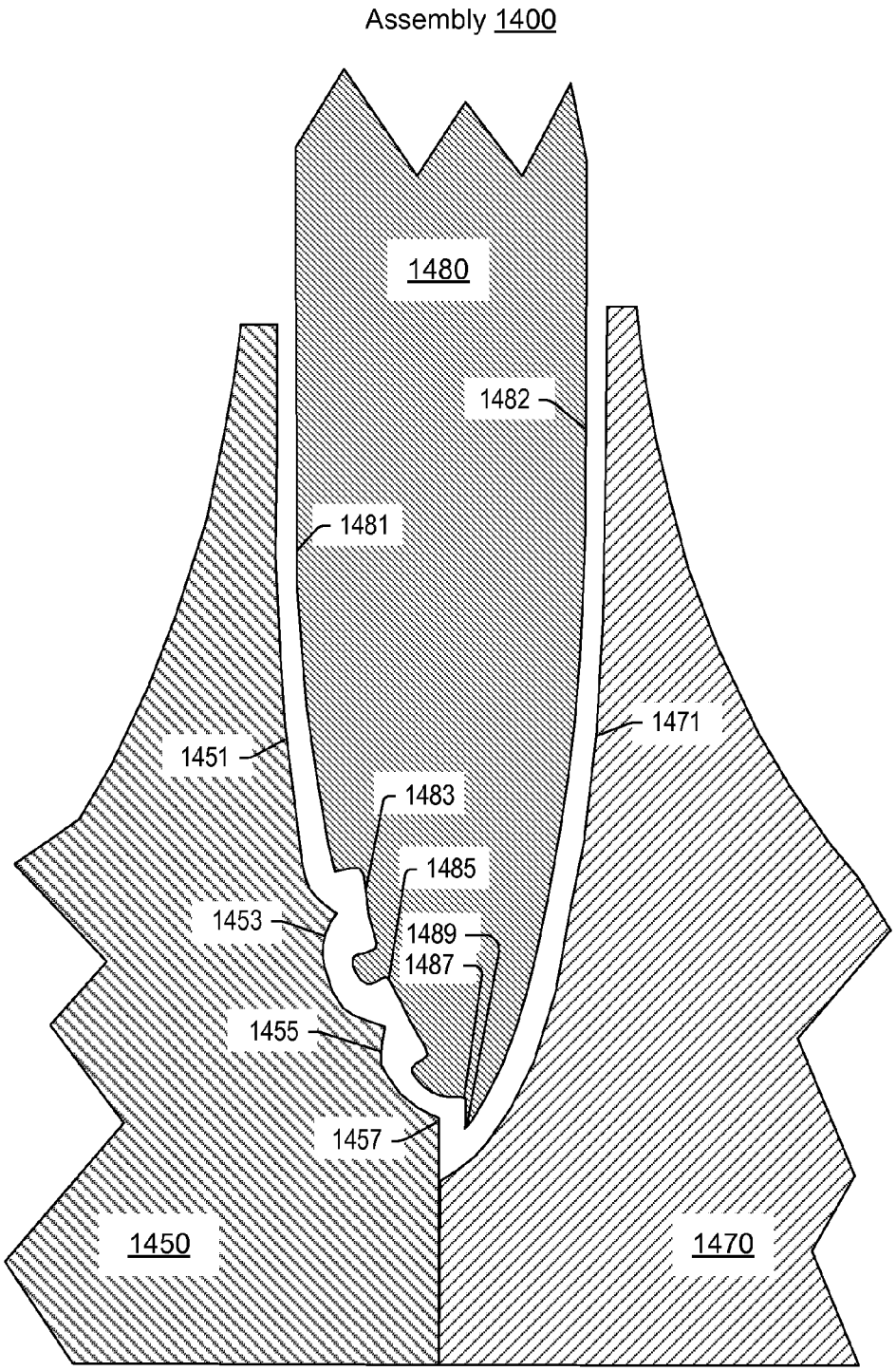
FIG. 14 is a cross-sectional view of a portion of an example of an assembly.

FIG. 14 shows an example of a portion of a multistage compressor assembly 1400 that includes a baffle 1480, a first compressor wheel 1450 and a second compressor wheel 1470. As shown, the baffle 1480 includes surfaces 1481 and 1482, channels 1483 and 1485, an end notch 1487 and an end 1489. As shown, the compressor wheel 1450 includes a hub surface 1451, annular ridges 1453 and 1455 and a corner 1457 while the compressor wheel 1470 includes a hub surface 1471.

Figure 15:
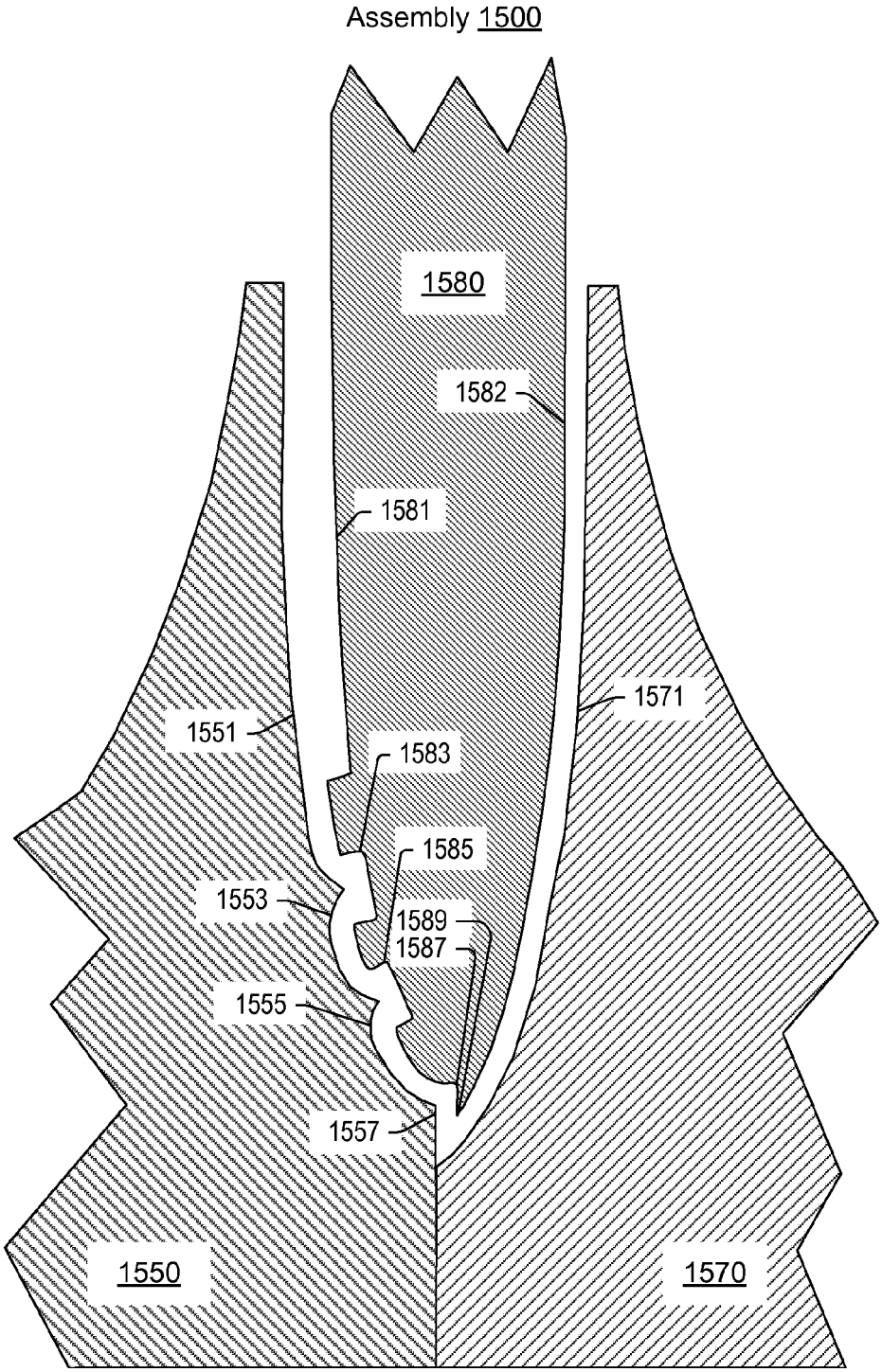
FIG. 15 is a cross-sectional view of a portion of an example of an assembly.

FIG. 15 shows an example of a portion of a multistage compressor assembly 1500 that includes a baffle 1580, a first compressor wheel 1550 and a second compressor wheel 1570. As shown, the baffle 1580 includes surfaces 1581 and 1582, channels 1583 and 1585, an end notch 1587 and an end 1589. In the example of FIG. 15, the surface 1581 and the channel 1583 are separated by an annular ridge. As shown, the compressor wheel 1550 includes a hub surface 1551, annular ridges 1553 and 1555 and a corner 1557 while the compressor wheel 1570 includes a hub surface 1571.

Figure 16:
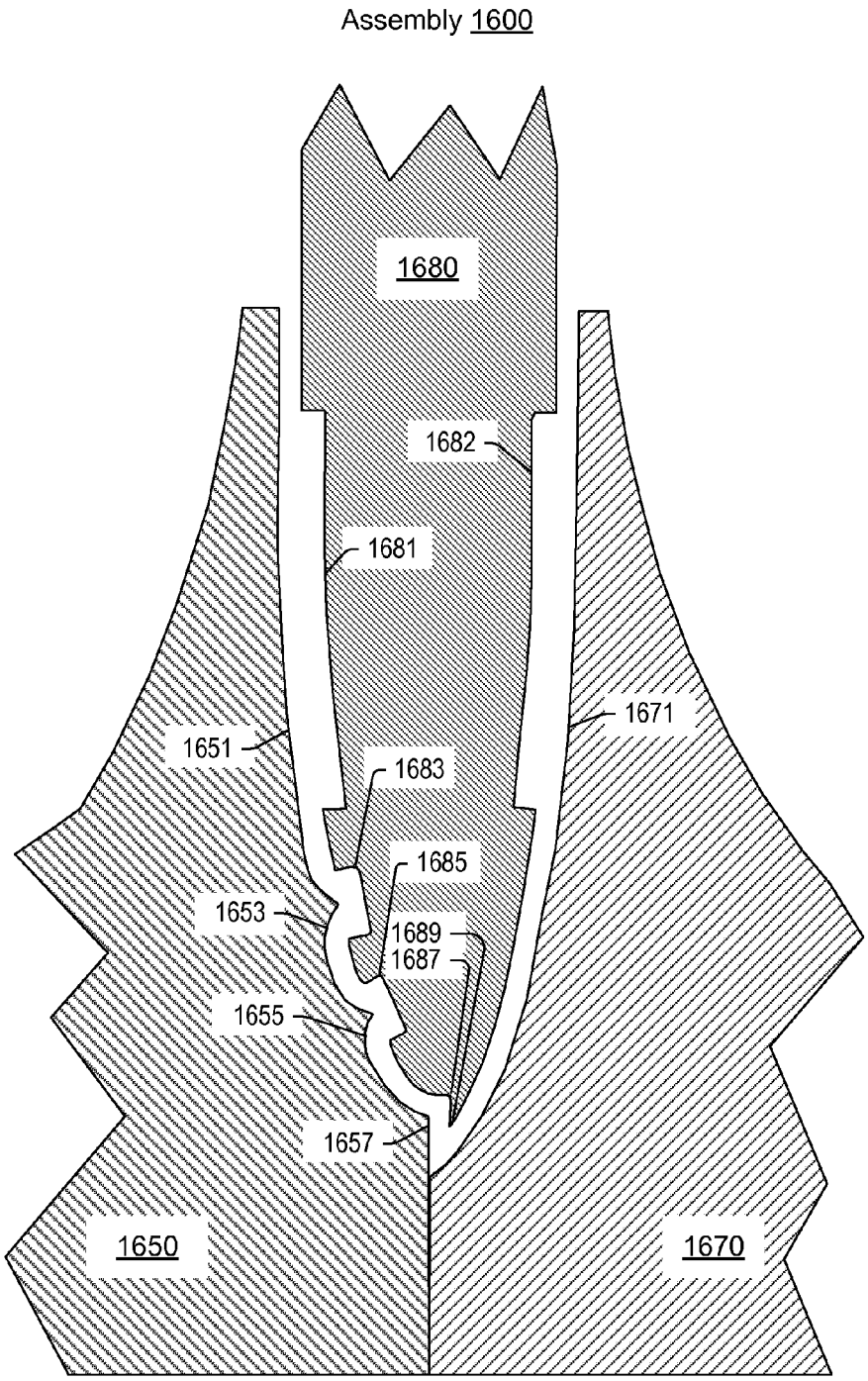
FIG. 16 is a cross-sectional view of a portion of an example of an assembly.

FIG. 16 shows an example of a portion of a multistage compressor assembly 1600 that includes a baffle 1680, a first compressor wheel 1650 and a second compressor wheel 1670. As shown, the baffle 1680 includes channels 1681, 1682, 1683 and 1685, an end notch 1687 and an end 1689. In the example of FIG. 16, the channels 1681 and 1682 rise to respective surfaces that extend radially outwardly and past an end of the compressor wheel 1650 and an end of the compressor wheel 1670, respectively. As shown, the compressor wheel 1650 includes a hub surface 1651, annular ridges 1653 and 1655 and a corner 1657 while the compressor wheel 1670 includes a hub surface 1671.

FIG. 17 shows a table 1700 that includes information as to the baffles 380, 1080, 1180, 1280, 1380, 1480, 1580 and 1680 as included in the assemblies 300, 1000, 1100, 1200, 1300, 1400, 1500 and 1600.

In the table 1700, information is shown for pressure differentials of 150 kPa and 200 kPa and for rotational speeds of 1 rpm and 185,000 rpm. The information includes mass flow (kg/s) and a flow decrease with respect to the assembly 1300 of FIG. 13. The example assemblies 300, 1400 and 1500 exhibit flow decreases that exceed the flow decreases of the other example assemblies 1300, 1000, 1100, and 1200. The example assemblies 300, 1400 and 1500 include features that are on a low pressure side of a two stage compressor assembly.

As an example, an annular baffle for a two stage radial compressor assembly can include an outer edge; and a substantially parabolic portion that includes an inner edge that defines an opening having a central axis and opposing surfaces that extend from the inner edge where one of the opposing surfaces includes an annular notch adjacent to the inner edge where the annular notch is defined in part by a radial notch width. In such an example, one of the opposing surfaces can include a first substantially semi-parabolic shape and the other of the opposing surfaces can include a second substantially semi-parabolic shape where, for example, a radial offset between ends of the opposing surfaces defines the radial notch width.

As an example, an annular notch can include an annular axial face. As an example, an annular notch may include a tip end at a first radius (e.g., at an opening) and a shoulder end at a second radius. In such an example, an annular axial face may extend from the first radius to the second radius (e.g., where the second radius is greater than the first radius). As an example, an annular notch may be shaped somewhat like a "notch" formed in part by the underside of a fingernail that extends past an end of an index finger. For example, an annular notch may be formed in part by a curved surface that is undercut by an undercut surface to form a tip end and where another curved surface meets the undercut surface at a shoulder end (see, e.g., the example of FIG. 8). As an example, an annular notch can be defined in part by a surface that includes a radius of curvature defined by a portion of a torus.

As an example, an annular baffle can include opposing surfaces where one of the opposing surfaces includes an annular channel located between an inner edge and an outer edge of the annular baffle. In such an example, the inner edge may define an opening where a first compressor wheel and a second compressor wheel may be assembly hub end to hub end. In such an example, a hub end of one of the compressor wheels may include a radius that exceeds a radius of a hub end of the other compressor wheel. In such an example, a notch may be formed. For example, consider two faces with different diameters that may be directly in contact with each other where an annular notch is formed where the smaller diameter face ends. As an example, an annular notch of an annular baffle may accommodate the larger diameter face while a tip of the annular baffle extends radially inwardly toward the end of the smaller diameter face (see, e.g., the example of FIG. 3).

As an example, an annular channel of an annular baffle may be located between an annular notch that extends radially outwardly from an inner edge of the annular baffle and an outer edge of the annular baffle. As an example, an annular baffle can include opposing surfaces where one of the opposing surfaces can include at least two annular channels located between an inner edge and an outer edge of the annular baffle.

As an example, an annular baffle can include opposing surfaces where one of the opposing surfaces can include a low pressure surface portion to one side of an inner edge of the annular baffle for facing a hub portion of a first radial compressor wheel and the other of the opposing surfaces can include a high pressure surface portion to the other side of the inner edge for facing a hub portion of a second radial compressor wheel. In such an example, the low pressure surface portion may include an annular notch adjacent to the inner edge. In such an example, the low pressure surface portion may include at least one annular channel. In such an example, the low pressure surface portion may include at least two annular channels. In such an example, the annular baffle may include an annular wall disposed between two of the at least two annular channels. In such an example, the annular wall may include a wall width that is less than a minimum annular channel width of the two of the at least two annular channels.

As an example, an assembly can include a first radial compressor wheel that has a rotational axis and that includes a hub surface that includes an annular ridge disposed at a radius measured from the rotational axis; a second radial compressor wheel that includes a hub surface; and an annular baffle disposed at least in part between the hub surfaces where the annular baffle includes an outer surface and an inner edge that defines an opening having a central axis where the outer surface includes a surface portion to one side of the inner edge that faces the hub surface of the first radial compressor wheel, where the surface portion includes an annular channel over a radial width measured from the central axis and where the radial width spans the radius of the annular ridge. In such an example, the annular baffle may include two annular channels where, for example, the hub surface of the first radial compressor wheel may include two annular ridges.

As an example, an annular baffle can include an outer surface that includes a surface portion to a side of an inner edge of the annular baffle that faces a hub surface of one of two radial compressor wheels where, for example, the surface portion may include a continuous semi-parabolic shape. In such an example, a surface portion to another side of the inner edge may include, for example, one or more of an annular notch and an annular channel. As an example, a hub surface of a radial compressor wheel may include a continuous semi-parabolic shape and, for example, a hub surface of another radial compressor wheel may include one or more annular ridges. As an example, hub surfaces may contact where an annular notch is formed where a smaller diameter hub surface ends to form an annular corner (e.g., or shoulder) and where a larger diameter hub surface extends radially outwardly from the annular corner (e.g., or shoulder).

As an example, a baffle can include an annular notch adjacent to an inner edge of the baffle. In such an example, the annular notch can include an axial annular face that faces an axial face of one of two radial compressor wheels (e.g., assembled in a hub-to-hub orientation).

As an example, a first radial compressor wheel can include an axial face defined by a first diameter and a second radial compressor wheel can include an axial face defined by a second diameter where the first diameter exceeds the second diameter. As an example, such radial compressor wheels may be assembled on a shaft in a hub-to-hub orientation, optionally in direct contact with each other, optionally with an axial gap therebetween, optionally with an axial spacer therebetween, etc. As an example, two radial compressors wheels may be fit to a shaft where, for example, the shaft extends through a bore of one of the radial compressor wheels and at least partially into a bore of the other of the radial compressor wheels. As an example, one radial compressor wheel may include a through bore while the other radial compressor wheel may be "boreless" in that in includes a partial bore that does not extend through the entire radial compressor wheel. In such an example, a boreless wheel may include one or more features that can receive one or more features of a shaft to join the boreless wheel to the shaft (e.g., consider bayonet features, thread features, etc.).

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions.

What is claimed is:

1. An annular baffle for a two stage radial compressor assembly with first and second radial compressor wheels assembled in a hub-to-hub orientation with respect to corresponding first and second exducer portions, the annular baffle comprising:

an outer edge;

a substantially parabolic portion that comprises an inner edge that defines an opening having a central axis and opposing surfaces that extend from the inner edge wherein one of the opposing surfaces comprises an annular notch adjacent to the inner edge wherein the annular notch is defined in part by a radial notch width; and between the inner edge and the outer edge, a first diffuser surface that forms a portion of a first diffuser section that receives gas that exits the first exducer portion and an opposing second diffuser surface that forms a portion of a second diffuser section that receives gas that exits the second exducer portion.

2. The annular baffle of claim 1 wherein one of the opposing surfaces comprises a first substantially semi-parabolic shape and wherein the other of the opposing surfaces comprises a second substantially semi-parabolic shape wherein a radial offset between ends of the opposing surfaces defines the radial notch width.

3. The annular baffle of claim 1 wherein the annular notch comprises an annular axial face.

4. The annular baffle of claim 1 wherein one of the opposing surfaces comprises an annular channel located between the inner edge and the outer edge.

5. The annular baffle of claim 4 wherein the annular channel is located between the annular notch and the outer edge.

6. The annular baffle of claim 4 wherein the one of the opposing surfaces comprises at least two annular channels located between the inner edge and the outer edge.

7. The annular baffle of claim 1 wherein one of the opposing surfaces comprises a low pressure surface portion to one side of the inner edge for facing a first hub portion of the first radial compressor wheel and the other of the opposing surfaces comprises a high pressure surface portion to the other side of the inner edge for facing a second hub portion of the second radial compressor wheel.

8. The annular baffle of claim 7 wherein the low pressure surface portion comprises the annular notch adjacent to the inner edge.

9. The annular baffle of claim 8 wherein the low pressure surface portion comprises at least one annular channel.

10. The annular baffle of claim 9 wherein the low pressure surface portion comprises at least two annular channels.

11. The annular baffle of claim 10 comprising an annular wall disposed between two of the at least two annular channels.

12. The annular baffle of claim 11 wherein the annular wall comprises a wall width that is less than a minimum annular channel width of the two of the at least two annular channels.

13. The annular baffle of claim 1 wherein the annular notch is defined at least in part by a surface that comprises a radius of curvature defined by a portion of a torus.

14. An assembly comprising:

a first radial compressor wheel that has a rotational axis and that comprises a first hub surface that comprises an annular ridge disposed at a radius measured from the rotational axis;

a second radial compressor wheel that comprises a second hub surface; and an annular baffle disposed at least in part between the first and second hub surfaces wherein the annular baffle comprises an outer surface and an inner edge that defines an opening having a central axis wherein the outer surface comprises a surface portion to one side of the inner edge that faces the first hub surface, wherein the surface portion comprises an annular channel that comprises a radial width, as measured with respect to the central axis, and wherein the radial width of the annular channel of the annular baffle spans the radius of the annular ridge of the first hub surface of the first radial compressor wheel.

15. The assembly of claim 14 wherein the annular baffle comprises two annular channels and wherein the first hub surface comprises two annular ridges.

16. The assembly of claim 14 wherein the outer surface comprises a surface portion to the other side of the inner edge that faces the second hub surface wherein the surface portion comprises a continuous semi-parabolic shape.

17. The assembly of claim 16 wherein the second hub surface of the second radial compressor wheel comprises a continuous semi-parabolic shape.

18. The assembly of claim 14 wherein the annular baffle comprises an annular notch adjacent to the inner edge.

19. The assembly of claim 18 wherein the annular notch comprises an axial annular face that faces an axial face of the first radial compressor wheel.

20. The assembly of claim 14 wherein the first radial compressor wheel comprises an axial face defined by a first diameter and wherein the second radial compressor wheel comprises an axial face defined by a second diameter wherein the first diameter exceeds the second diameter.

* * * * *